US008342516B2

(12) United States Patent
Yamazaki

(10) Patent No.: US 8,342,516 B2
(45) Date of Patent: Jan. 1, 2013

(54) IMAGE READING APPARATUS AND IMAGE FORMING SYSTEM

(75) Inventor: Masato Yamazaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 922 days.

(21) Appl. No.: 12/292,663

(22) Filed: Nov. 24, 2008

(65) Prior Publication Data

US 2009/0136275 A1 May 28, 2009

(30) Foreign Application Priority Data

Nov. 26, 2007 (JP) ..... 2007-304780

(51) Int. Cl.
*B65H 31/26* (2006.01)

(52) U.S. Cl. ..... 271/220; 271/3.01; 271/3.14

(58) Field of Classification Search ..... 271/3.01, 271/3.14, 220
See application file for complete search history.

(56) References Cited

U.S. PATENT DOCUMENTS

| | | | | |
|---|---|---|---|---|
| 6,241,236 | B1 * | 6/2001 | Bokelman | 271/3.01 |
| 6,810,231 | B2 * | 10/2004 | Kobayashi et al. | 399/367 |
| 6,973,285 | B2 * | 12/2005 | Sekiyama et al. | 399/367 |
| 7,857,306 | B2 * | 12/2010 | Enomoto | 271/213 |
| 2001/0017438 | A1 * | 8/2001 | Takamtsu | 271/3.14 |
| 2006/0071413 | A1 * | 4/2006 | Kaneko et al. | 271/220 |
| 2007/0071493 | A1 | 3/2007 | Eguchi | |
| 2009/0127766 | A1 * | 5/2009 | Nakaishi | 271/3.01 |
| 2009/0218749 | A1 * | 9/2009 | Shingai | 271/3.14 |
| 2009/0218750 | A1 * | 9/2009 | Shingai | 271/3.14 |
| 2009/0322010 | A1 * | 12/2009 | Kusama | 271/3.14 |

FOREIGN PATENT DOCUMENTS

| | | | |
|---|---|---|---|
| DE | 4309445 | A1 * | 9/1993 |
| JP | 4-8132 | | 3/1992 |
| JP | 9-65029 | | 3/1997 |
| JP | 2001-22143 | | 1/2001 |
| JP | 2007-096889 | | 4/2007 |

* cited by examiner

*Primary Examiner* — Prasad Gokhale
(74) *Attorney, Agent, or Firm* — Rabin & Berdo, P.C.

(57) ABSTRACT

An image reading apparatus includes an image reader, a document feeder, and a document retainer. A document feeder feeds the document to the image reader, and the image reader reads an image of a document. The document feeder discharges the document onto a stacker after the image of the document has been read. The document feeder is pivotal relative to the image reader. When the document feeder opens relative to the reader at an angle, the document retainer presses the document against the stacker.

13 Claims, 29 Drawing Sheets

IMAGE READING APPARATUS AND IMAGE FORMING SYSTEM

BACKGROUND OF THE INVENTION

1. Field of the Invention

The present invention relates to an image forming system, and to an image reading apparatus that incorporates an automatic document feeder (ADF).

2. Description of the Related Art

There are various types of conventional image forming apparatuses which incorporate an image reading unit mounted on an image forming unit. Such image forming apparatuses include copying machines, facsimile machines, and multi-function printers (MFP). The image reading unit includes a scanner cover adapted to open and close. A user opens the scanner cover, places a document on a flatbed glass, and then closes the cover to hold the document in position before reading the document. Some scanners incorporate an ADF unit mounted on a scanner cover, so that a plurality of pages of document may be fed in sequence to the flatbed glass or ADF glass with the scanner cover closed.

In order to facilitate replacement of consumable items such as a fixing unit disposed in the image forming unit, the top cover of the image forming unit is adapted to open by an angle of substantially 90°.

The image reading unit is journaled on the image forming unit such that the image reading unit is pivotal about an axis relative to the image forming unit. Therefore, if the document remains on the ADF unit, the document will drop from the ADF unit when the image reading unit is opened inadvertently.

SUMMARY OF THE INVENTION

An object of the invention is to solve the aforementioned drawbacks of the conventional image forming apparatuses.

Another object of the invention is to provide an image reading apparatus in which a document feeder is adapted to open and close relative to the image forming unit and a retaining plate retains the document in cooperation with the opening operation of the document feeder so that when the document feeder is opened, the document will not drop off.

An image reading apparatus includes an image reader, a document feeder, and a document retainer. A document feeder feeds the document to the image reader, and the image reader reads an image of a document. The document feeder discharges the document onto a stacker after the image of the document has been read. The document feeder is pivotal relative to the image reader. When the document feeder opens relative to the reader at an angle, the document retainer presses the document against the stacker.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

Figure 1:
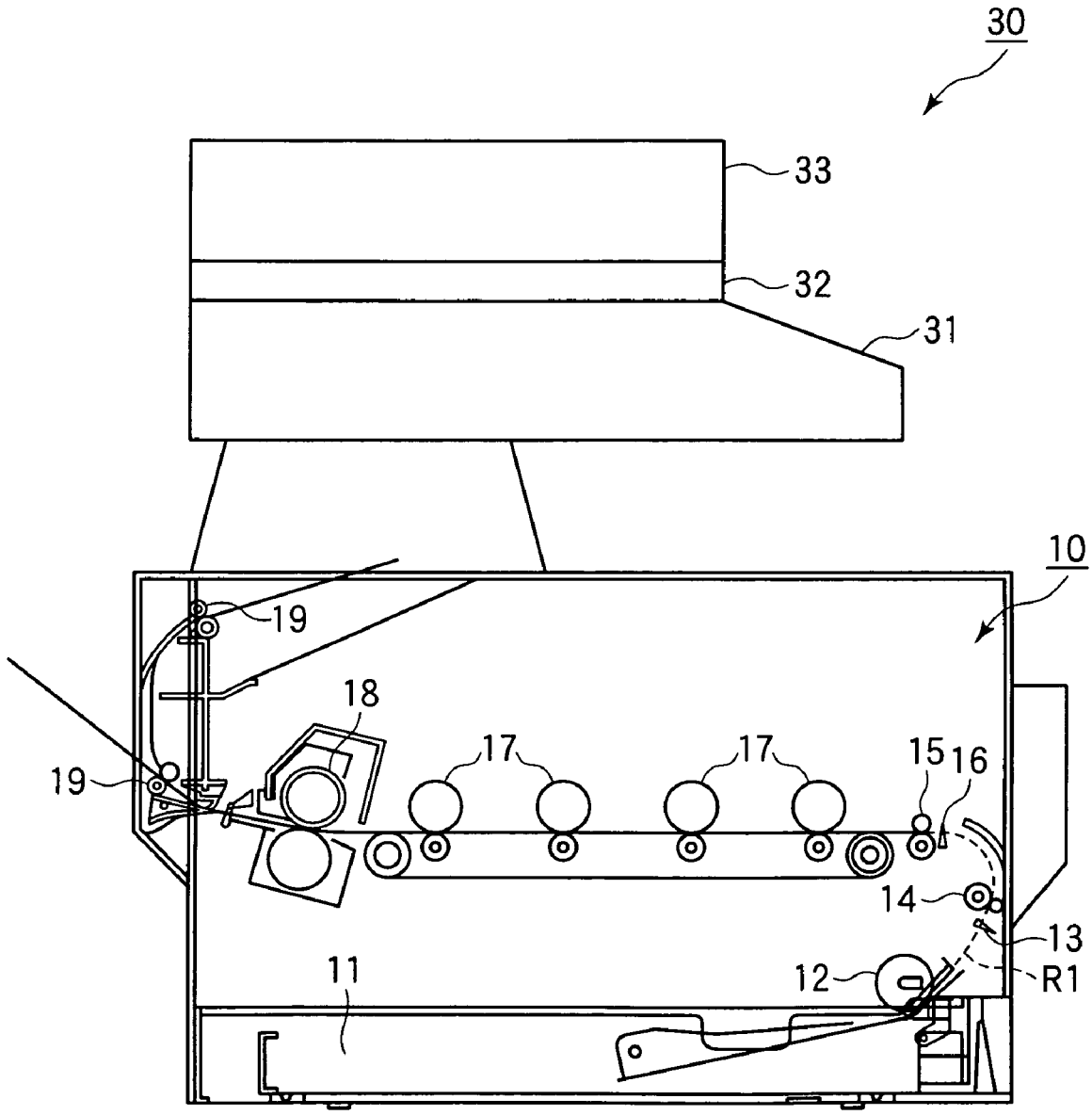
FIG. 1 is a side view of an image forming apparatus of a first embodiment.

FIG. 1 is a side view of an image forming apparatus of a first embodiment.

Referring to FIG. 1, the image forming apparatus includes a printer 10 as an image forming unit and an image reading apparatus 30 as an image reading unit. The image forming apparatus takes the form of, for example, a copying machine, a facsimile machine, or a multi function printer (MFP). The image forming apparatus of the first embodiment may be any type of apparatus provided that the image forming apparatus includes the printer 10 and the image reading apparatus 30.

The printer 10 may be either a monochrome printing device or a color printing device. Additionally, the printer 10 may be of any type including an ink jet printer and a thermal transfer printer. In the specification, the embodiment will be described in terms of a tandem type electrophotographic color printer that includes four image drum units 17 capable of forming yellow (Y) magenta (M), cyan (C) and black (K) toner images, respectively.

The printer 10 includes a paper cassette 11, four image drum units 17, and a fixing unit 18. The paper cassette 11 holds a stack of print paper, and feeds the paper on a page-by-page basis to the image drum units 17. The image drum units 17 transfer toner images of corresponding colors onto the print paper fed from the paper cassette 11. The fixing unit 18 fixes the toner images on the print paper.

A feed roller 12 is disposed at the exit of the paper cassette 11, and feeds the print paper on a page-by-page basis.

A sensor 13, a transport roller 14, and a transport roller 15, and a sensor 16 are disposed in this order along a path R1 extending from the paper cassette 11 to the image drum units 17. The sensors 13 and 16 detect the print paper when the print paper advances past the sensors 13 and 16. The transport roller 14 corrects the skew of the print paper. The transport roller 15 feeds the print paper into the image drum units 17.

The image drum units 17 each perform processes of charging, developing, and transferring. Toner images of the respective colors are transferred in sequence by the transfer rollers onto the print paper. The toner images on the print paper are then fused into the print paper as the print paper passes through a fixing point defined between a heat roller and a pressure roller in the fixing unit 18.

A discharge roller 19 is disposed along a transport path in which the print paper advances after leaving the fixing unit 18.

The image reading apparatus 30 includes a scanner 31, a scanner cover 32, and an automatic document feeder (ADF) unit 33, and is disposed over the printer 10. The scanner cover 32 covers the flatbed of the scanner unit 31. The ADF unit 33 feeds the document on a page-by-page basis to a later described reading device 22 disposed in the scanner unit 31. The reading device 22 is mounted integral with the scanner cover 32.

The configuration of the image reading apparatus 30 will be described in detail.

Figure 2:
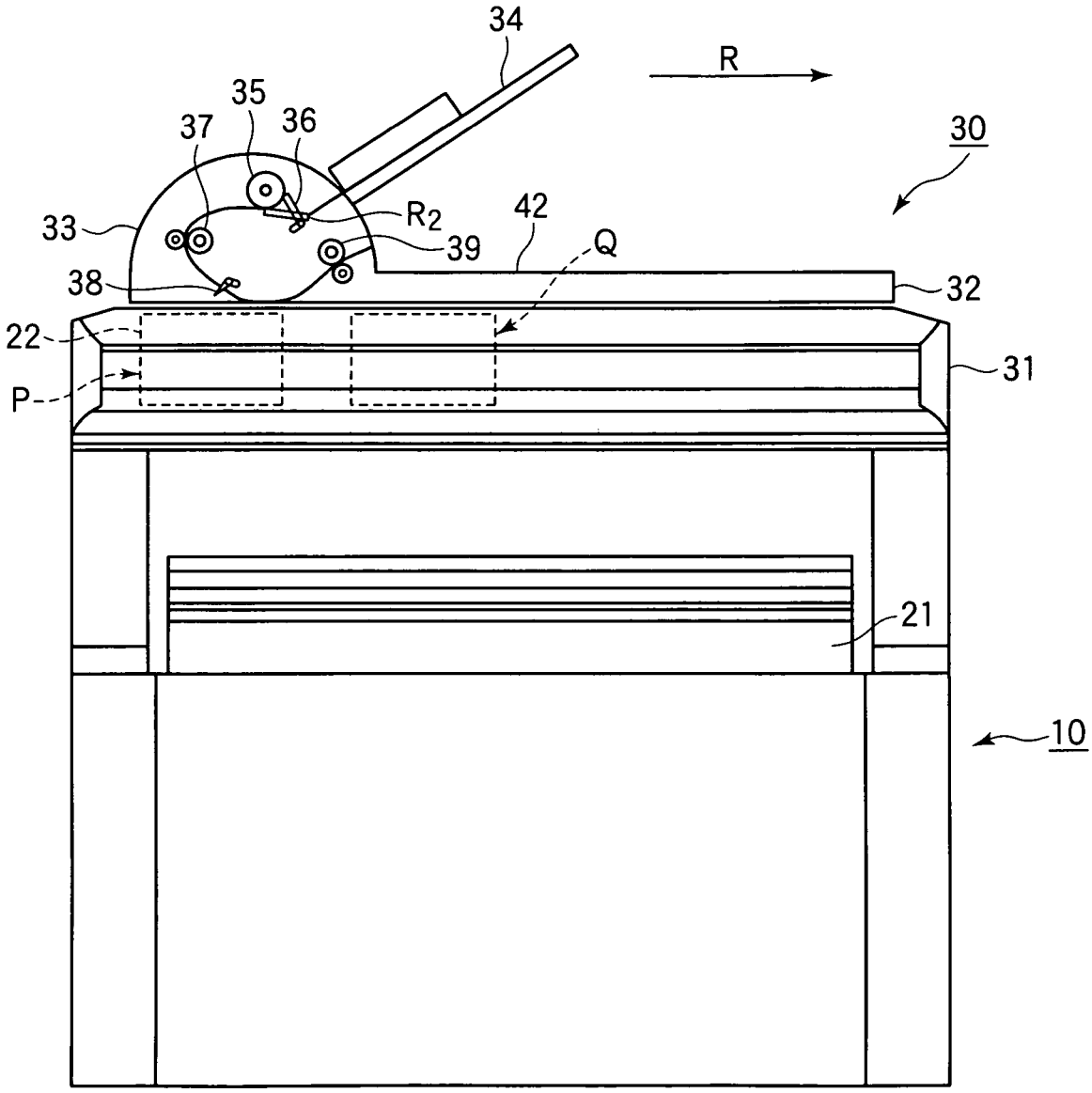
FIG. 2 is a front view of the image forming apparatus.

FIG. 2 is a front view of the image forming apparatus.

Referring to FIG. 2, the ADF unit 33 includes a document supporting tray 34, an ADF roller 35, a document sensor 36, a document transporting roller 37, a sensor 38 and a document discharging roller 39. The document supporting tray 34 supports the pages of a document placed thereon. The document sensor 36 detects the document when at least one page of document remains on or is placed on the document supporting tray 34. The sensor 38 detects the document when the document advances past the sensor 38.

The reading unit 22 is movable in the scanner 31. The reading unit 22 includes sensors in the form of, for example, a charge coupled device (CCD) or a complementary metal oxide semiconductor (CMOS), and optical elements in the form of, for example, lens and light-transmitting elements. The sensors and optical elements cooperate with one another to read an image of the document. In an automatic feed mode, the ADF feeds the pages of document to the scanner unit 31, and the reading unit 22 stays at position P and reads the image of the page of the document that advances relative to the reading unit 22. In a manual feed mode, the user places a page of document on the flatbed glass. The, the reading unit 22 moves rightward in FIG. 2 relative to the document at a constant speed from position Q, thereby reading the image of the page of document.

The page of document is fed into a path R2 from the document supporting tray 34, advancing past by the reading unit 22, and being discharged to the outside of the scanner unit 31. The pages of document are discharged from the scanner 31, and are stacked onto a stacker 42 formed on the scanner cover 32.

A printer cover 21 covers the upper portion of the printer 10, and is configured to open and close relative to the printer 10. The printer cover 21 is opened when the user removes a paper jam or replaces a consumable item.

The opening and closing operations of the ADF unit 33 will be described.

Figure 3B:
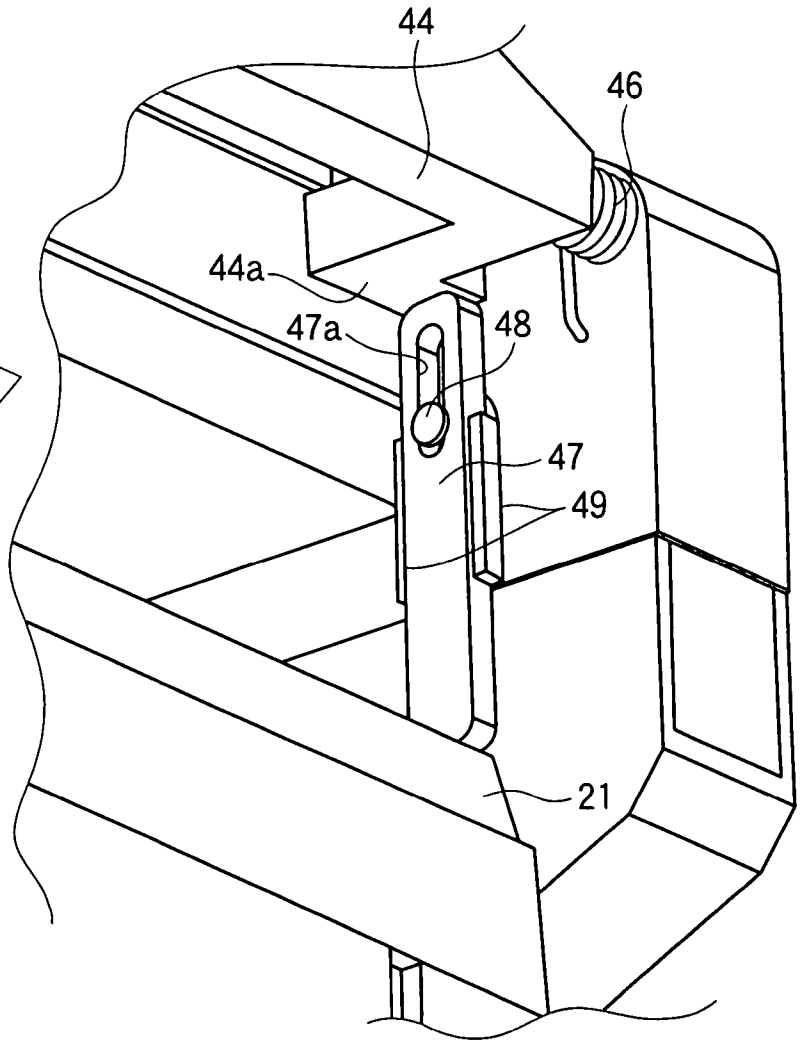
FIGS. 3A and 3B are perspective rear views of the image forming apparatus when an ADF unit is closed, FIG. 3A showing the appearance of the image forming apparatus and FIG. 3B being a partial expanded view of FIG. 3A.
Figure 3A:
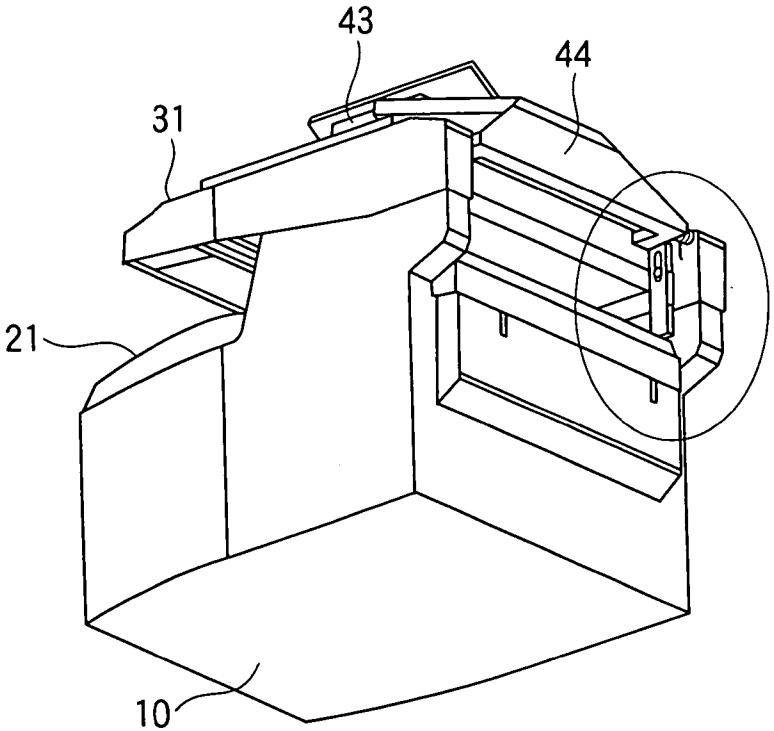

FIGS. 3A and 3B are perspective rear views of the image forming apparatus when the ADF unit 33 is closed. FIG. 3A shows the appearance of the image forming apparatus and FIG. 3B is a partial expanded view.

Figure 4:
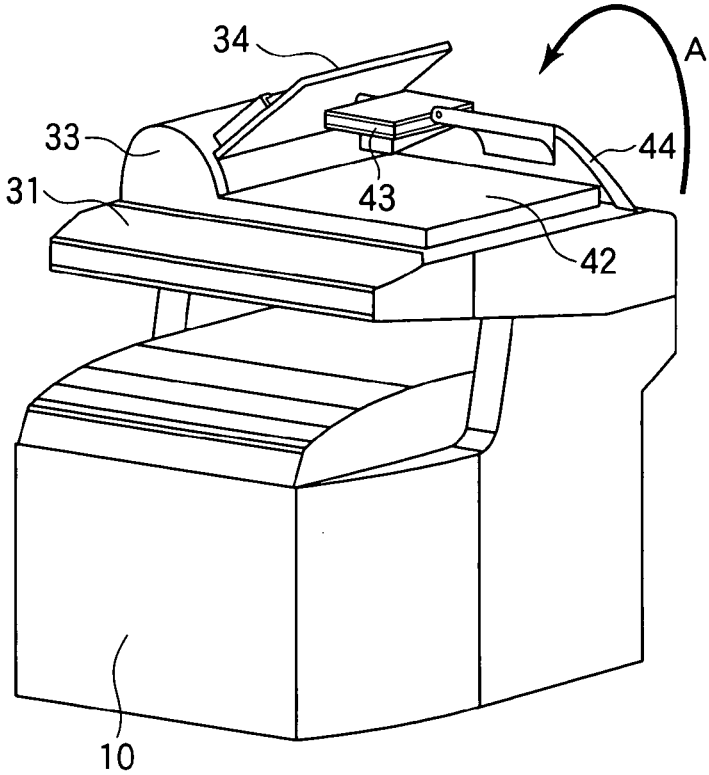
FIG. 4 is a perspective front view of the image forming apparatus when the ADF unit is closed.

FIG. 4 is a perspective front view of the image forming apparatus when the ADF unit 33 is closed.

Figure 5:
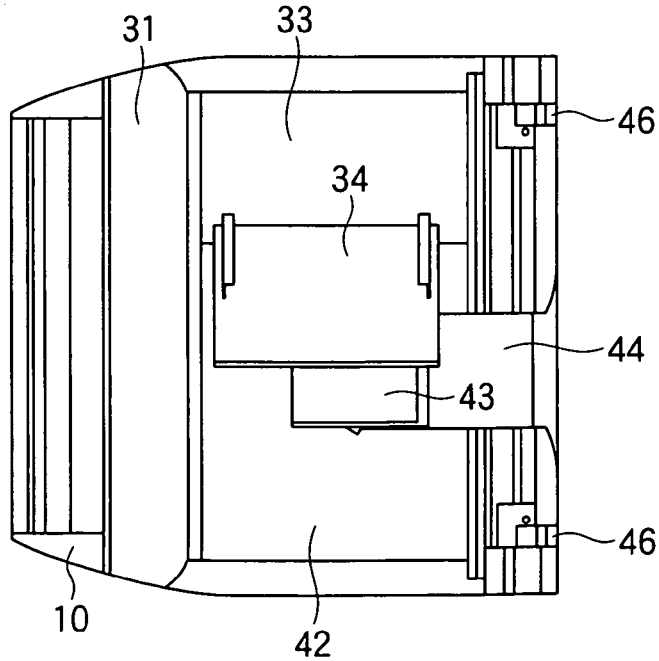
FIG. 5 is a top view of the image forming apparatus when the ADF unit is closed.

FIG. 5 is a top view of the image forming apparatus when the ADF unit 33 is closed.

Figure 6:
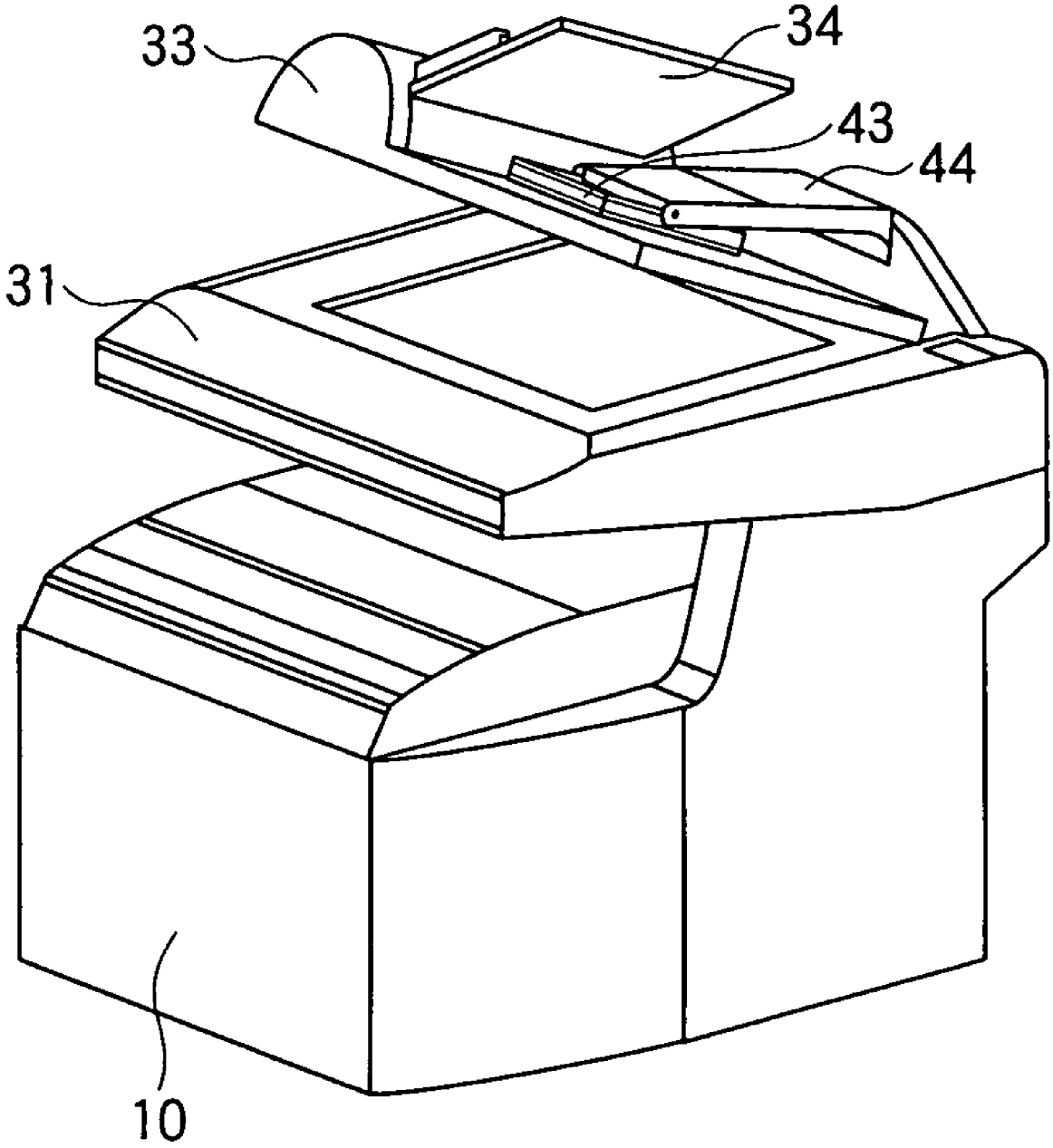
FIG. 6 is a perspective front view of the image forming apparatus when the ADF unit is open.

FIG. 6 is a perspective front view of the image forming apparatus when the ADF unit 33 is open.

The arm 44 is pivotal about an axis X-X (FIG. 10) relative to the scanner unit 31, and extends over the ADF unit 33. A document retainer 43 is pivotally mounted to a free end portion 44b (FIG. 7B) of the arm 44. When the ADF unit 33 is closed relative to the scanner unit 31, the document retainer 43 is held over the stacker 42 in place. As illustrated FIG. 7B, the document retainer 43 has a flat surface.

Referring to FIG. 5, torsion springs 45 and 46 are mounted on the shaft of the arm 44. The torsion springs 45 and 46 urge the arm 44 at all times in a direction shown by arrow A shown in FIG. 4.

Referring to FIG. 6, when the ADF unit 33 has been opened by a predetermined angle (e.g., approximately 20°), the document retainer 43 moves into contact with the upper surface of the stacker 42.

Links 47, pairs of ribs 49, and guide pins 48 are disposed in the vicinity of the shaft of the arm 44 at positions that are mirror images of one another with respect to a substantially mid point of the width of the printer 10. FIG. 3B shows the link 47, ribs 49, and guide pin 48, which are disposed on the right side portion of the scanner unit 31. The link 47, ribs 49, and guide pin 48 are also disposed on the left side portion of the scanner unit 31, though not shown. Each of the links 47 is guided by the ribs 49 and the guide pin 48 so that the link 47 is vertically movable by its own weight. The guide pin 48 is either press-fitted or screwed into the scanner 31 through an elongated hole 47*a* (FIG. 8B) formed in the link 47. The links 47 serve as a stopper to prevent the arm 50 urged by springs 51 and 52 in the A direction from pivoting any further than the position shown in FIG. 3B.

The operation of the image forming apparatus of the aforementioned configuration will be described in detail.

Figure 7A:
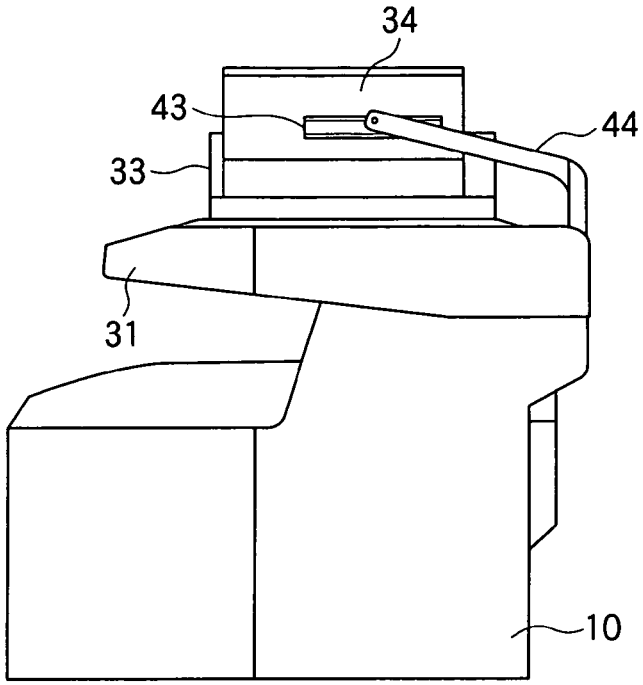
FIG. 7A is a right side view of the image forming apparatus when the ADF unit is closed.
Figure 7B:
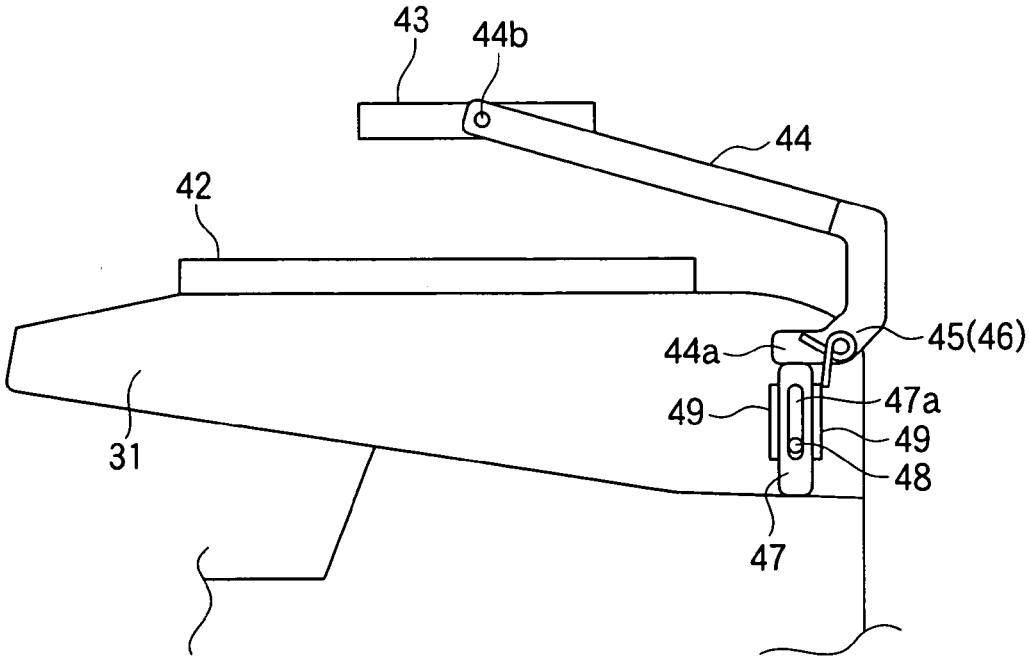
FIG. 7B illustrates the positional relationship between an arm and a link.

FIG. 7A is a right side view of the image forming apparatus when the ADF unit 33 is closed. FIG. 7B illustrates the positional relationship between the arm 44 and the link 47.

Figure 8:
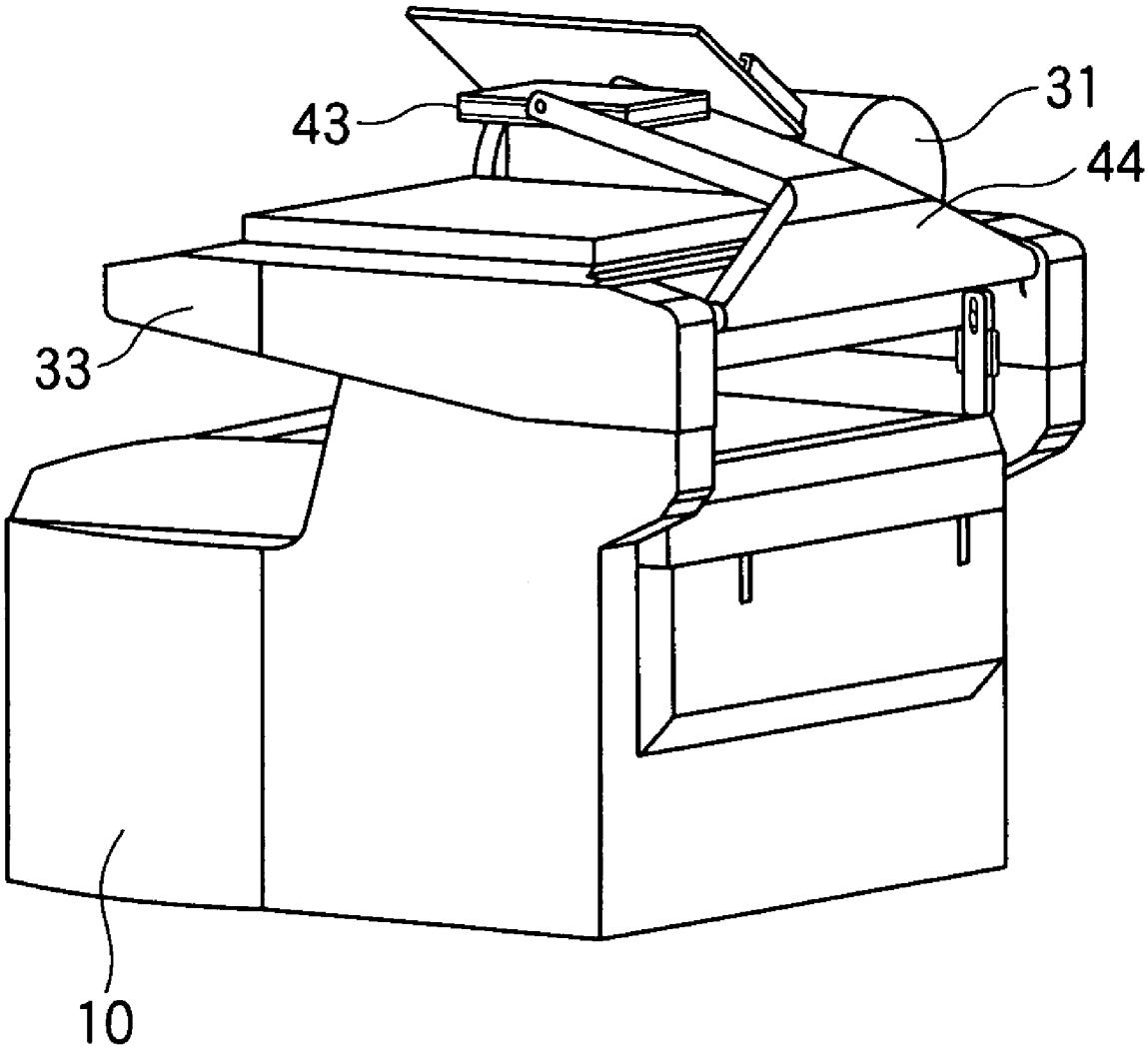
FIG. 8 is a perspective rear view of the image forming apparatus when the ADF unit is closed.

FIG. 8 is a perspective rear view of the image forming apparatus when the ADF unit 33 is closed.

Figure 9A:
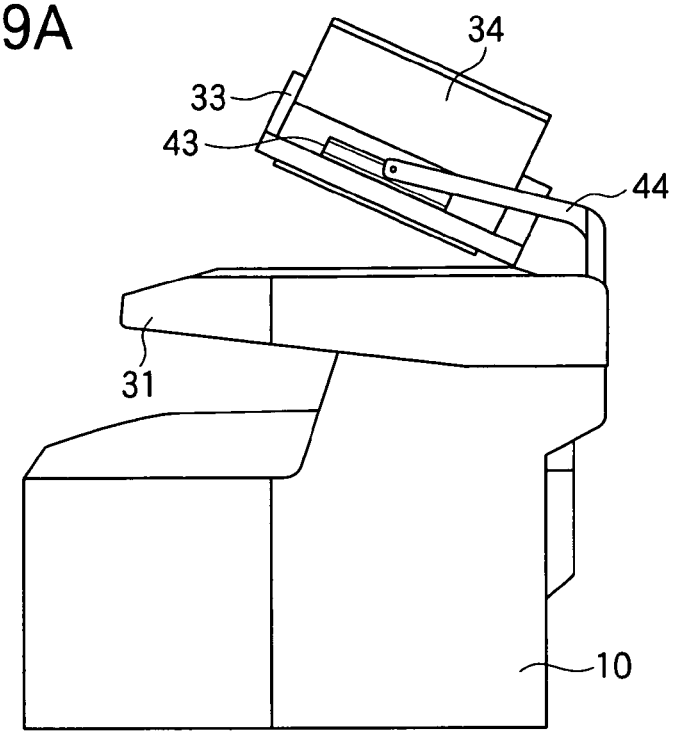
FIG. 9A is a right side view of the image forming apparatus when the ADF unit is opened by an angle of 20°.
Figure 9B:
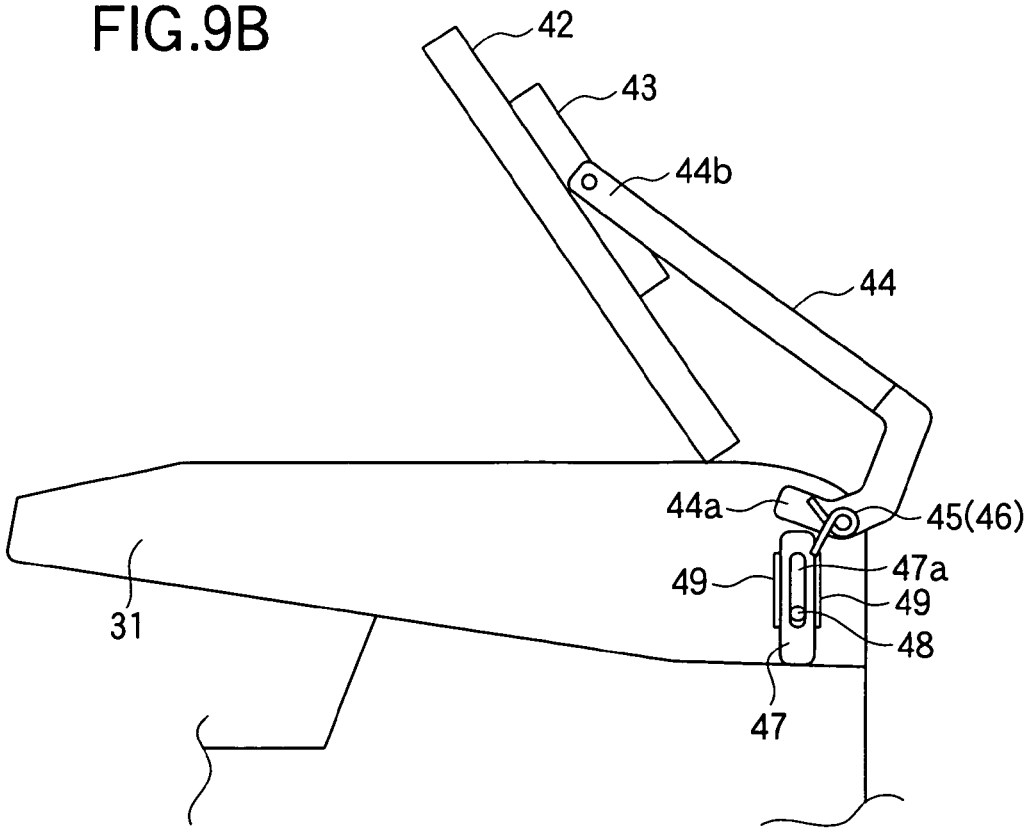
FIG. 9B illustrates the relationship between the arm and the link.

FIG. 9A is a right side view of the image forming apparatus when the ADF unit 33 is opened by an angle of 20°. FIG. 9B illustrates the relationship between the arm 44 and the link 47.

Figure 10:
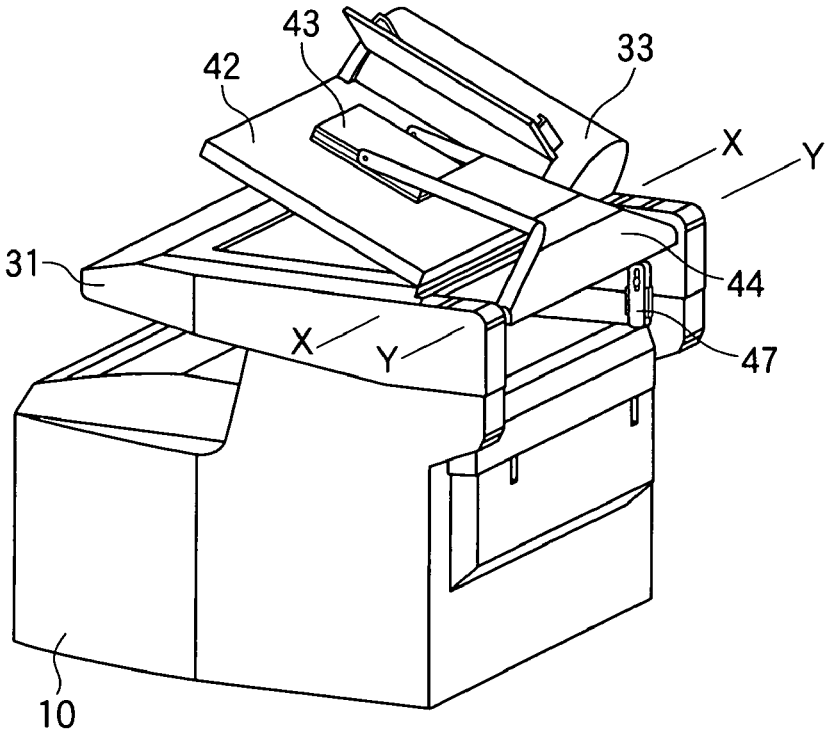
FIG. 10 is a perspective rear view of the image forming apparatus when the ADF unit is opened by an angle of 20°.

FIG. 10 is a perspective rear view of the image forming apparatus when the ADF unit 33 is opened by an angle of 20°.

Figure 11:
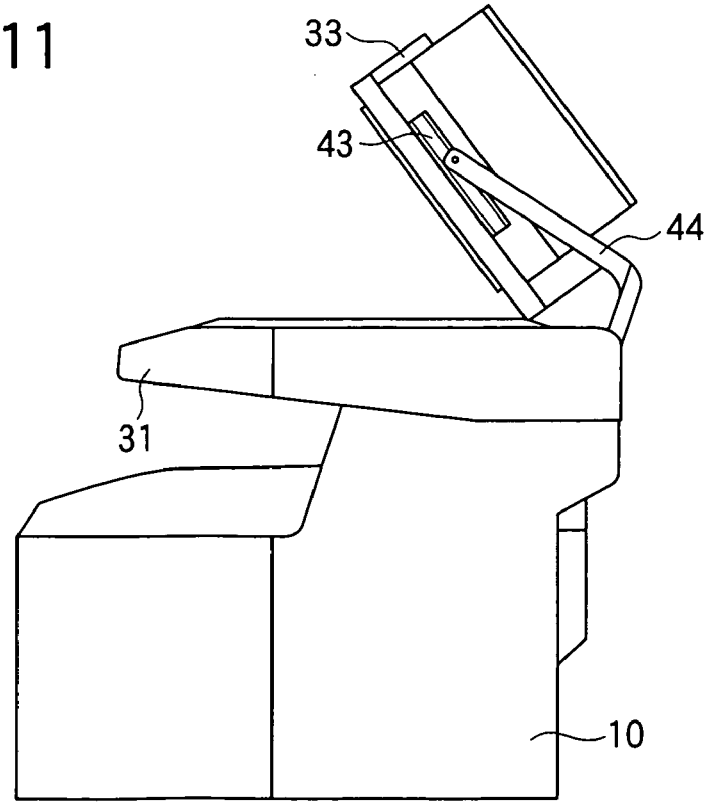
FIG. 11 is a right side view of the image forming apparatus when the ADF unit is opened by an angle of 55°.

FIG. 11 is a right side view of the image forming apparatus when the ADF unit 33 is opened by an angle of 55°.

Figure 12:
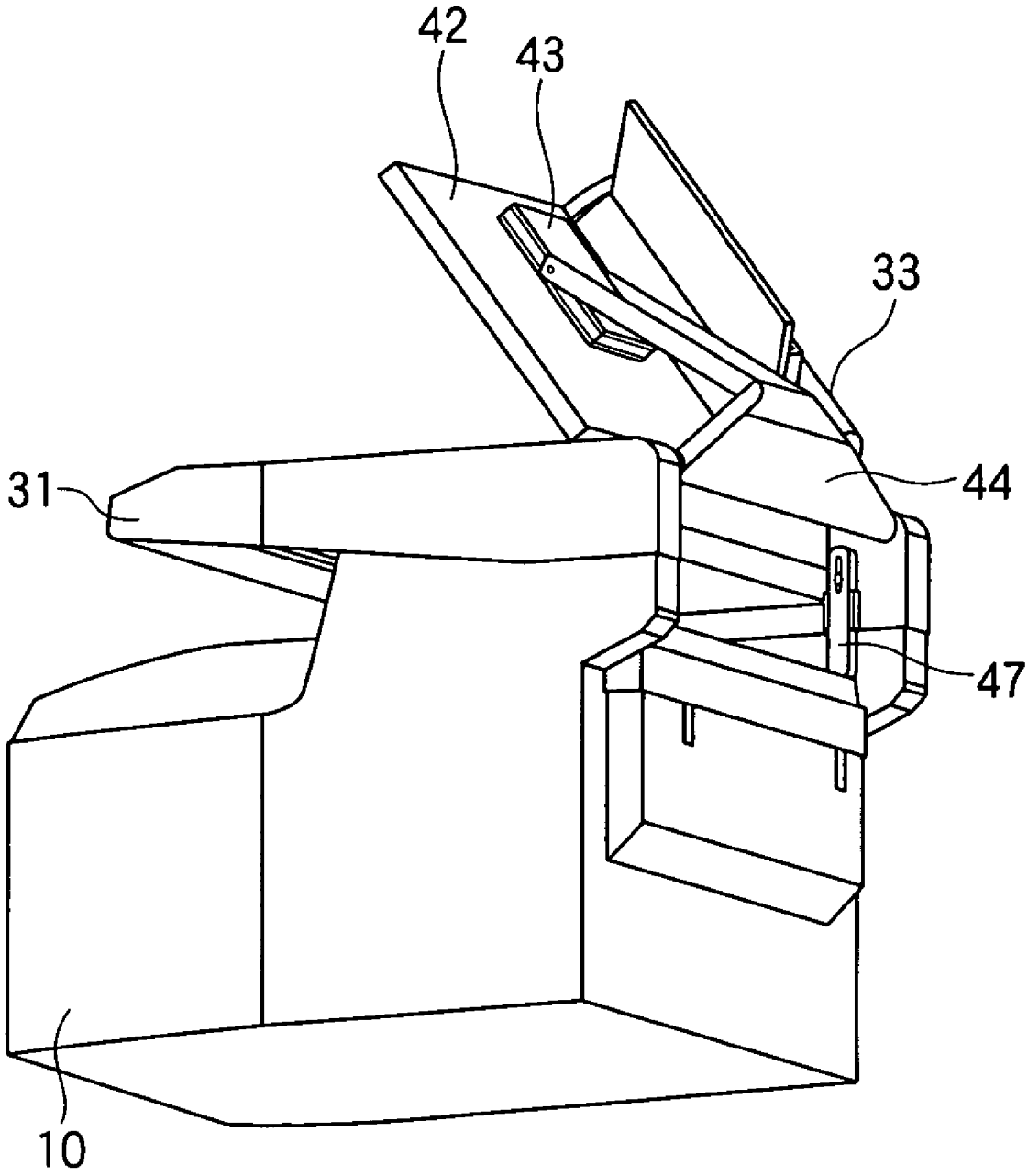
FIG. 12 is a perspective rear view of the image forming apparatus when the ADF unit is opened by an angle of 55°.

FIG. 12 is a perspective rear view of the image forming apparatus when the ADF unit 33 is opened by an angle of 55°.

Figure 13A:
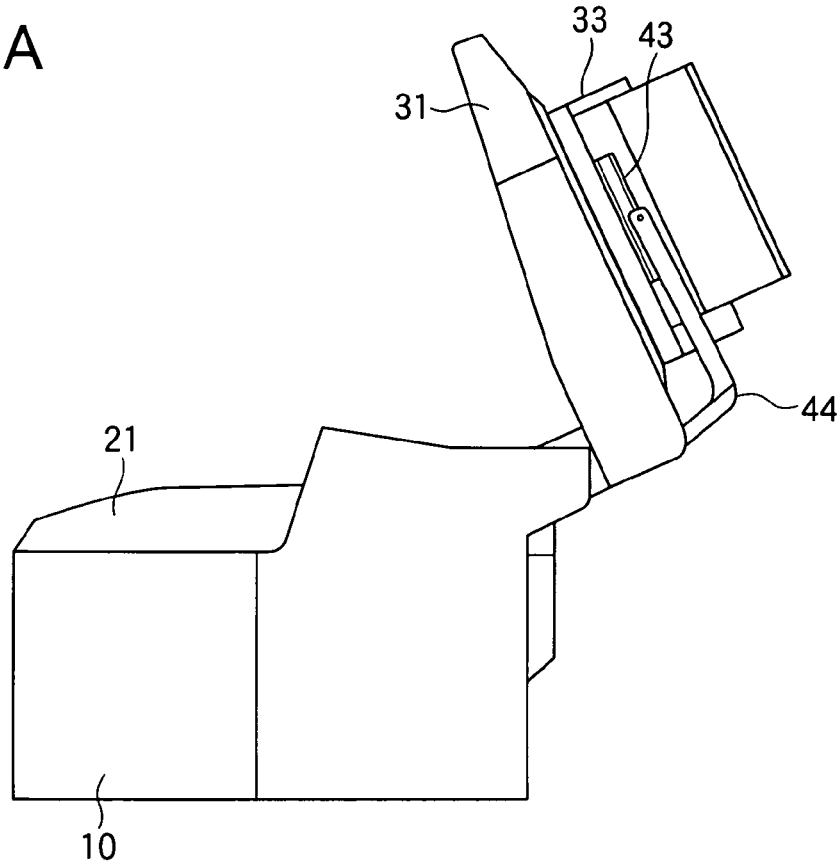
FIG. 13A is a right side view of the image forming apparatus when a scanner unit is opened by an angle of 65°.
Figure 13B:
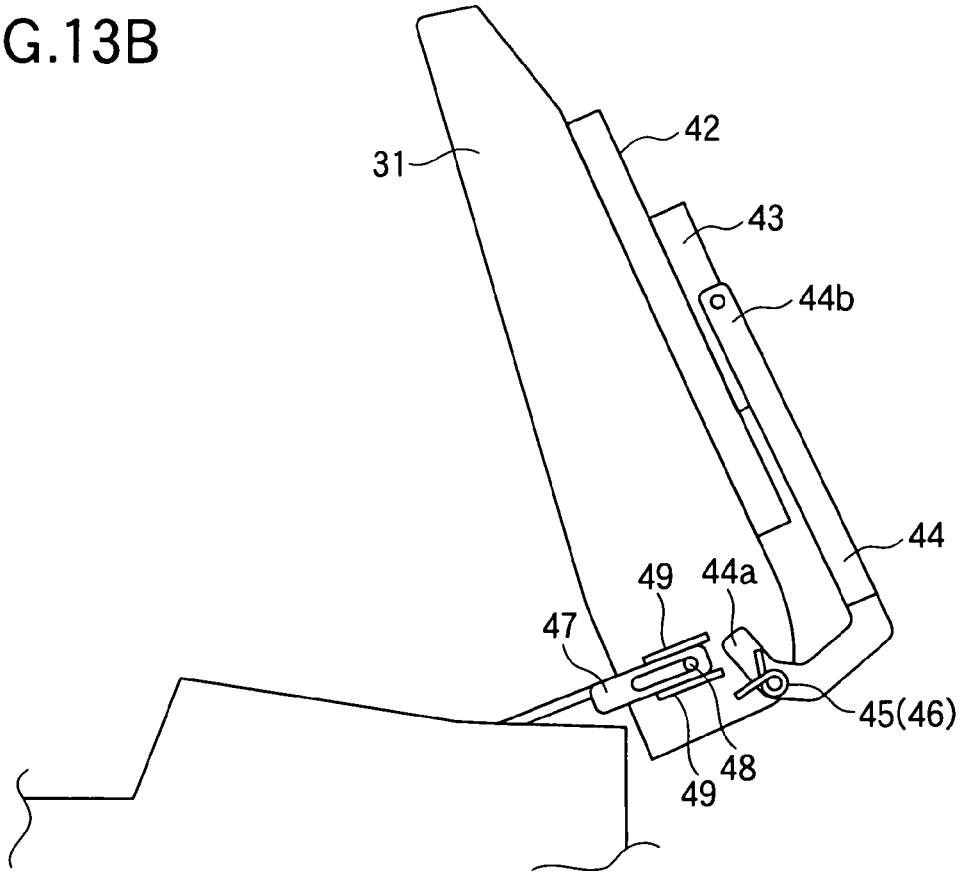
FIG. 13B illustrates the relationship between the arm 44 and the link.

FIG. 13A is a right side view of the image forming apparatus when the scanner unit 31 is opened by an angle of 65°. FIG. 13B illustrates the relationship between the arm 44 and the link 47.

Figure 14:
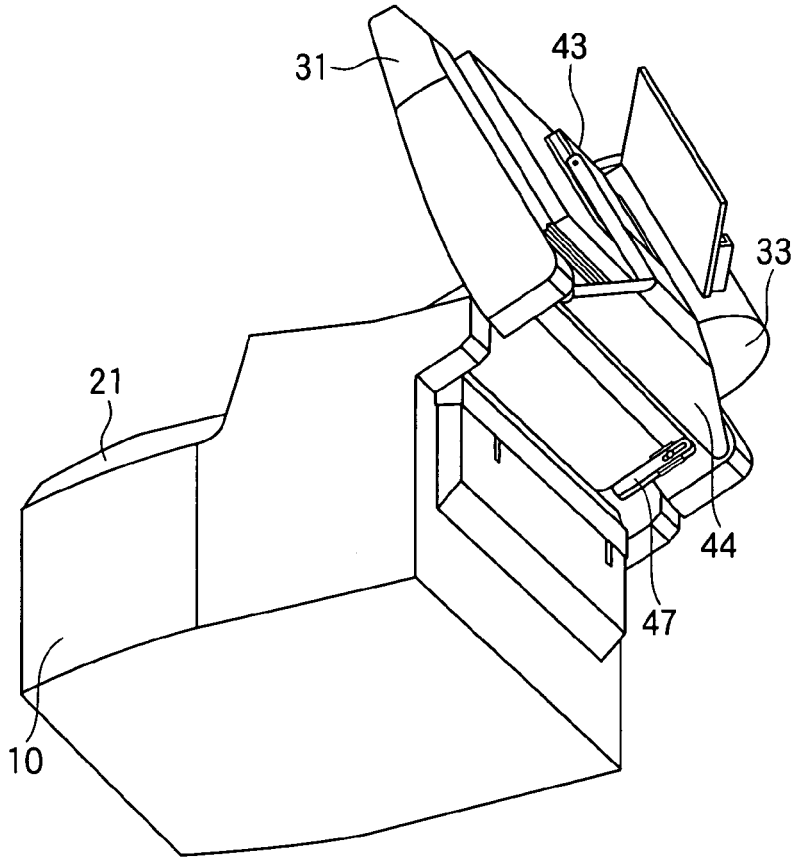
FIG. 14 is a perspective rear view of the image forming apparatus when the scanner unit is opened by an angle of 65°.

FIG. 14 is a perspective rear view of the image forming apparatus when the scanner unit 31 is opened by an angle of 65°.

Figure 15:
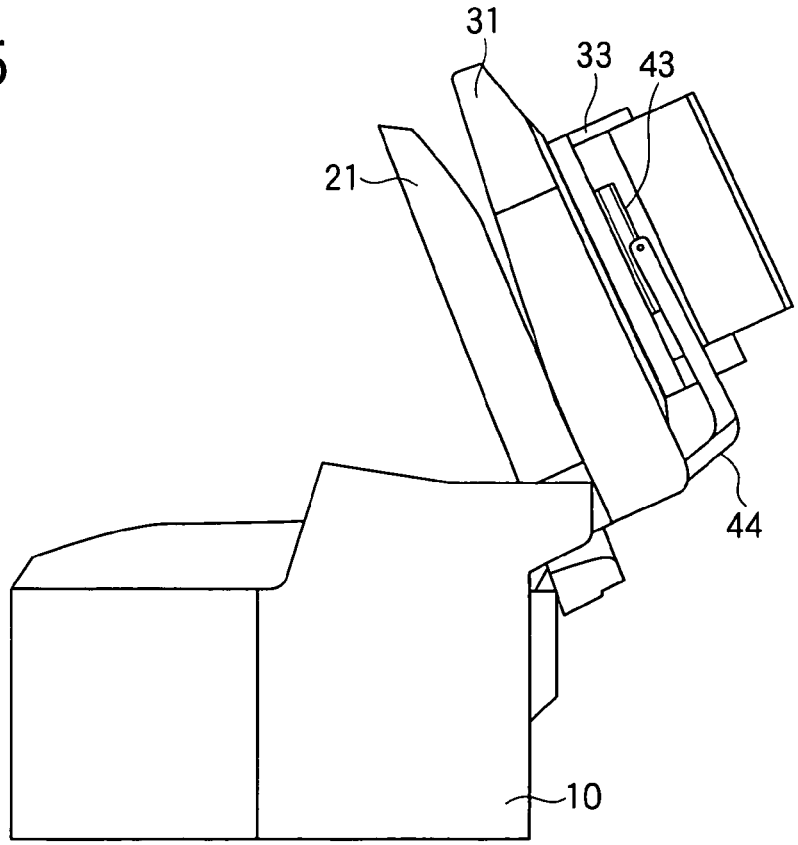
FIG. 15 is a right side view of the image forming apparatus when the scanner unit is opened by an angle of 65° and the printer cover is opened by an angle of 70°.

FIG. 15 is a right side view of the image forming apparatus when the scanner unit 31 is opened by an angle of 65° and the printer cover 21 is opened by an angle of 70°.

Figure 16:
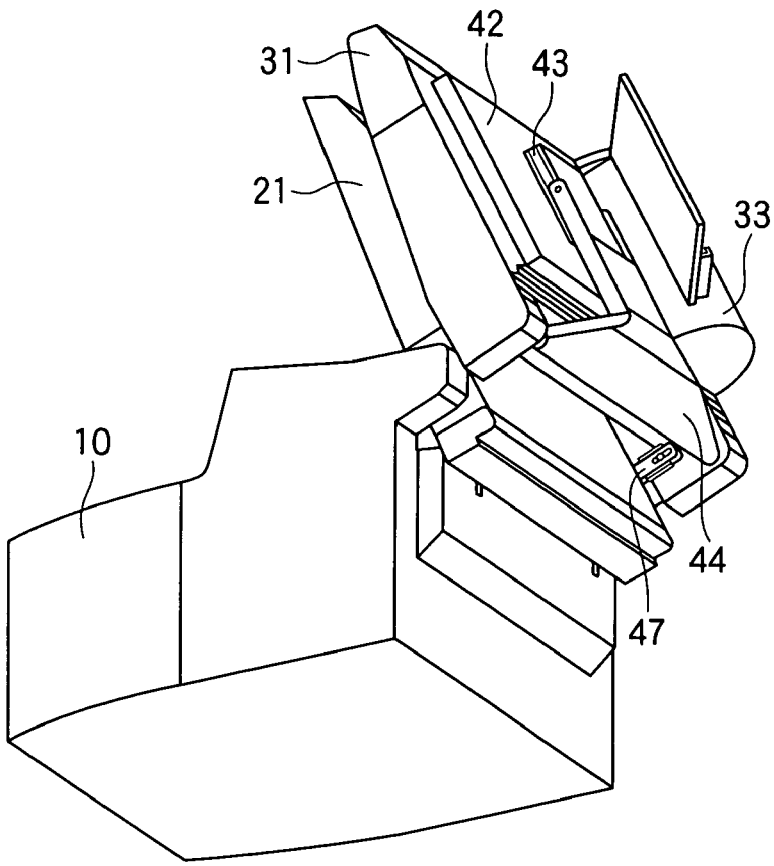
FIG. 16 is a perspective rear view of the image forming apparatus when the scanner unit 31 is opened by an angle of 65° and the printer cover is opened by an angle of 70°.

FIG. 16 is a perspective rear view of the image forming apparatus when the scanner unit 31 is opened by an angle of 65° and the printer cover 21 is opened by an angle of 70°.

FIGS. 7A, 7B and 8 illustrate the image forming apparatus in normal use when the ADF unit 33 and the scanner unit 31 have been closed. At this moment, the links 47 rests on the printer 10, and therefore the links 47 are prevented from moving downward relative to the scanner unit 31 any further. The link 47 also abuts an end portion 44*a* of the arm 44 serving as a stopper to prevent the arm 44 from further pivoting in the A direction. The arm 44 is urged in the A direction (FIG. 4) by the springs 45 and 46. As a result, the document retainer 43 is held over the ADF unit 33 in place.

For example, the user may wish to make a copy of only a page of document. When the user opens the ADF unit 33, he may find a sheet for the immediately preceding copying job remaining on the flatbed glass. When the user opens the ADF unit 33 by an angle of about 20° as shown in FIGS. 9 and 10, the document retainer 43 begins to press the document remaining on the stacker 42 against the stacker 42, and the link 47 no longer abuts the end portion 44*a* of the arm 44.

Referring to FIGS. 11 and 12, when the ADF unit 33 has been opened by an angle such that the user can see the surface of the flatbed glass, a portion 44*a* (FIG. 3B) of the arm 44 moves out of engagement with the link 47 in an opening direction (FIG. 11B) while being urged by the springs 45 and 46, the arm 44 pivoting about an axis Y-Y (FIG. 10) together with the ADF unit 33.

Subsequently, the user places the document on the flatbed glass. Then, the user closes the ADF unit 33 to the position shown in FIGS. 7A and 8, and then initiates a copying operation.

When, for example, a paper jam occurs in the printer 10 in the middle of the copying operation, the user opens the scanner unit 31. The document retainer 43 firmly presses the document against the stacker 42 using the flat surface thereof, allowing the user to open the scanner unit 31 as shown in FIGS. 13 and 14 without having to pay any attention to the documents remaining on the stacker 42.

Because the link 47 is loosely guided by the ribs 49 and the guide pin 48, opening the scanner unit 31 allows the link 47 to fully slide downward due to its own weight along the elongated hole (FIG. 13B) while being guided by the ribs 49 on the scanner unit 31. The urging forces of the springs 45 and 46 urge the arm 44 in such a direction that the document retainer 43 mounted to a tip portion of the arm 44 presses the document against the stacker 42.

Subsequently, as shown in FIGS. 15 and 16, the user opens the printer cover 21 that covers the upper surface of the printer 10, and removes the jammed paper. The user may also replace the toner cartridge and image drum of the image drum unit 17 disposed in the printer 10. After the jammed paper has been removed, the user closes the printer cover 21 to return the scanner unit 31 to its normal position (FIG. 4), so that the arm 44 and document retainer 43 return to their original position.

As described above, the arm 44 and document retainer 43 allow the ADF unit 33 and scanner unit 31 to open and close relative to the printer 10 while preventing the document from dropping from the stacker 42 of the ADF unit 33.

Second Embodiment

Elements similar to those of the first embodiment have been given the same reference numerals and their description is omitted. The description of the operations and advantages of the portions common to the first embodiment is also omitted.

Figure 17:
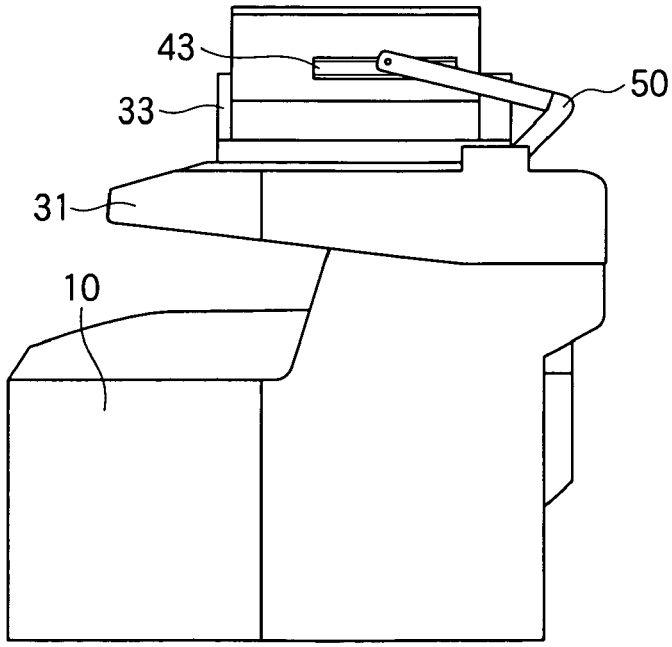
FIG. 17 is a right side view of an image forming apparatus of a second embodiment when an ADF is closed.

FIG. 17 is a right side view of the image forming apparatus when an ADF 33 is closed.

Figure 18A:
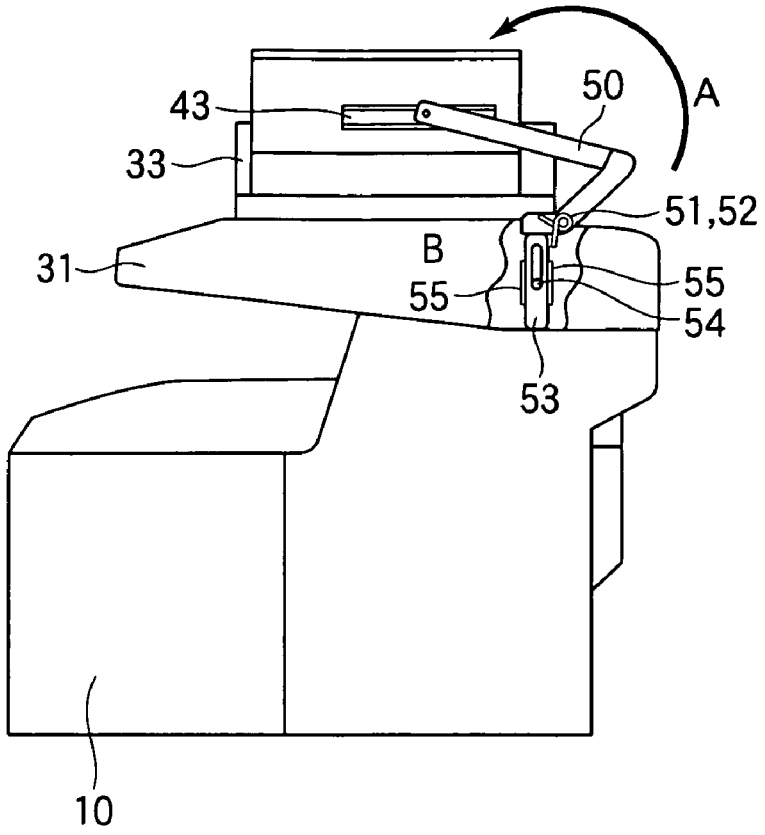
FIG. 18A is a partial cross-sectional view of the image forming apparatus when the ADF unit is closed.
Figure 18B:
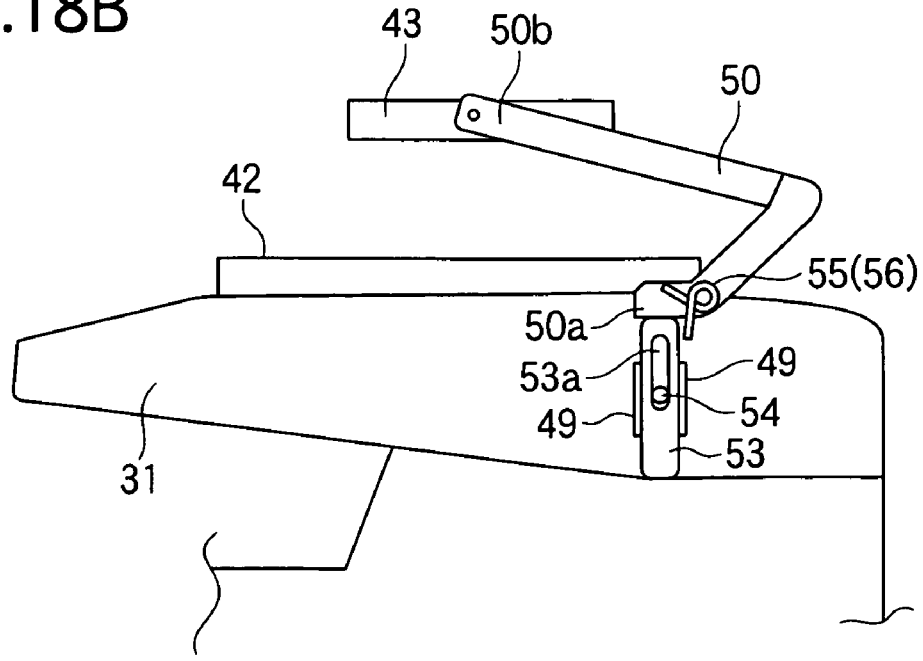
FIG. 18B illustrates the positional relationship between an arm and a link.

FIG. 18A is a partial cross-sectional view of the image forming apparatus when the ADF unit 33 is closed. FIG. 18B illustrates the positional relationship between the arm 50 and the link 53.

Figure 19:
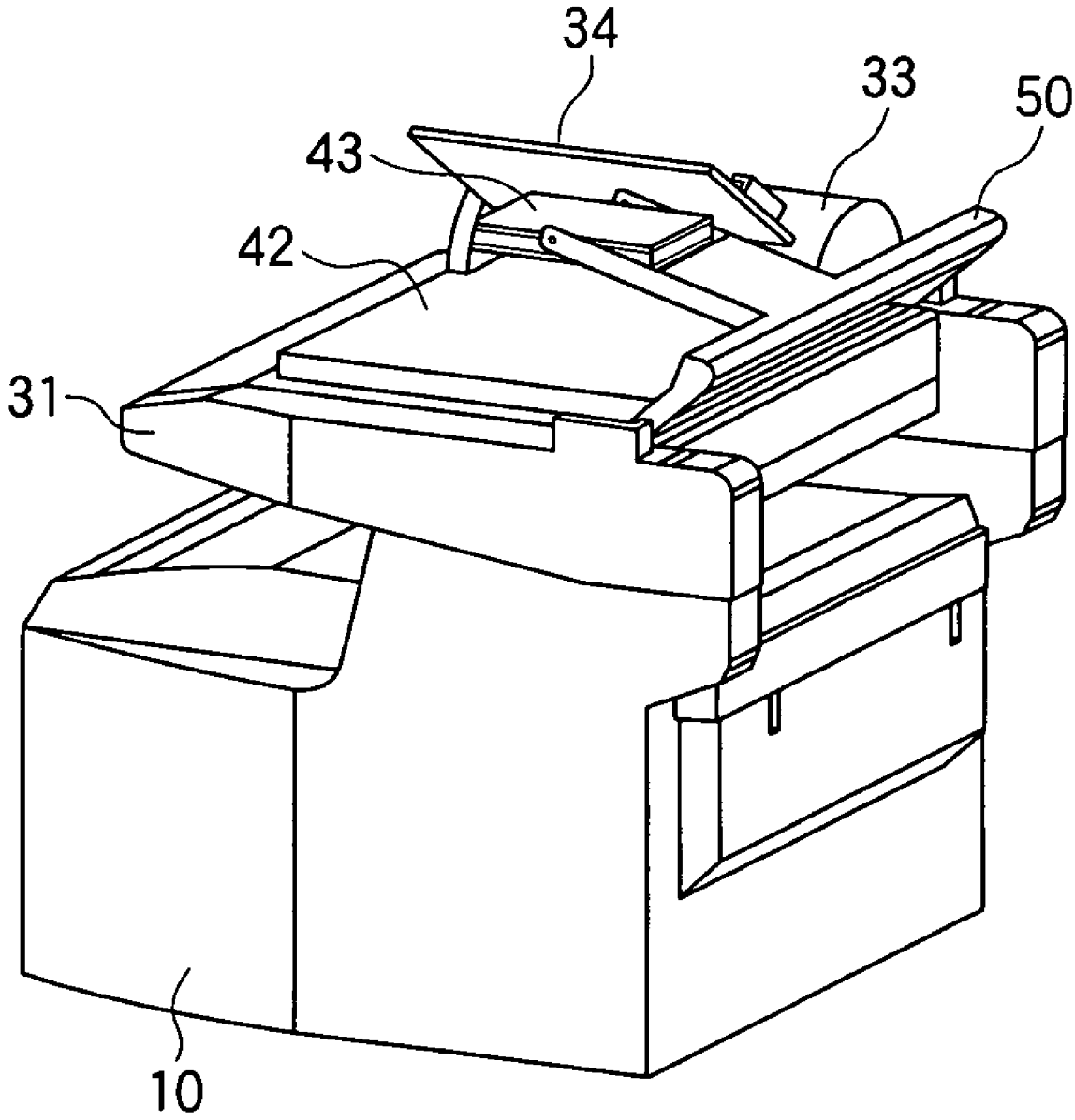
FIG. 19 is a perspective rear view of the image forming apparatus when the ADF unit is closed.

FIG. 19 is a perspective rear view of the image forming apparatus when the ADF unit 33 is closed.

Figure 20:
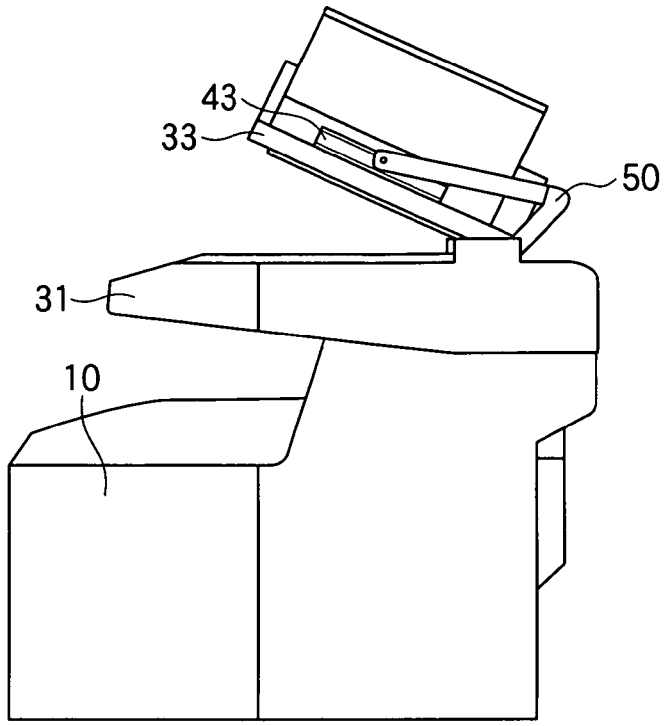
FIG. 20 is a right side view of the image forming apparatus when the ADF unit has been opened by 20°.

FIG. 20 is a right side view of the image forming apparatus when the ADF unit 33 has been opened by 20°.

Figure 21:
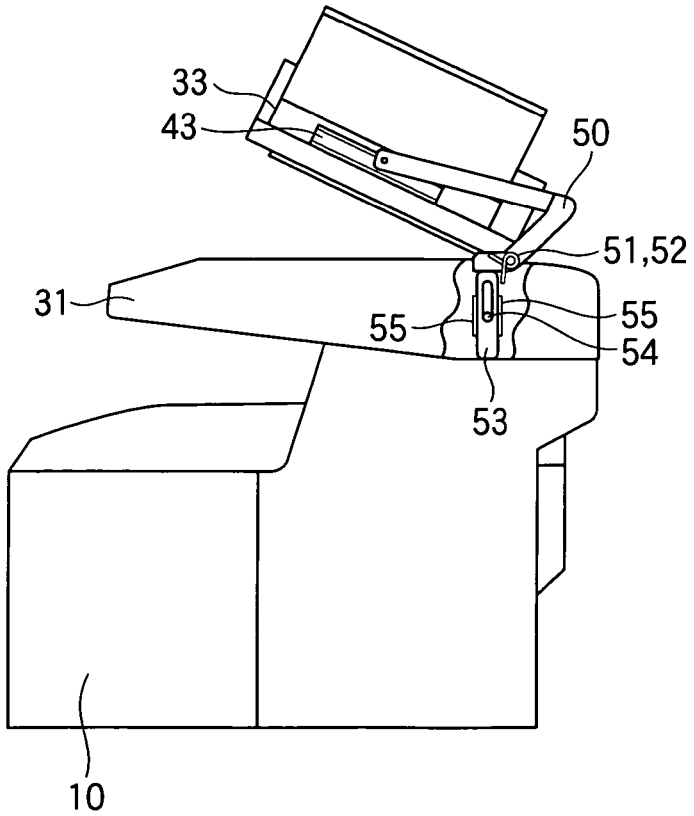
FIG. 21 is a partial cross-sectional view of the image forming apparatus when the ADF unit has been opened by 20°.

FIG. 21 is a partial cross-sectional view of the image forming apparatus when the ADF unit 33 has been opened by 20°.

Figure 22:
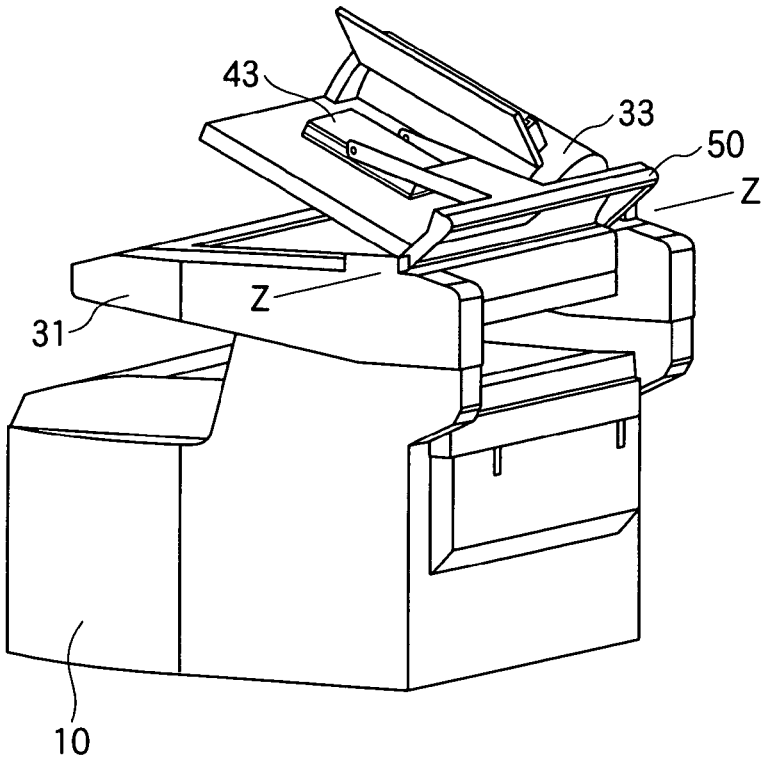
FIG. 22 is a perspective rear view of the image forming apparatus when the ADF unit has been opened by 20°.

FIG. 22 is a perspective rear view of the image forming apparatus when the ADF unit 33 has been opened by 20°.

The document retainer 43 is pivotally mounted to a free end portion 50*b* of an arm 50. Referring to FIGS. 17A, 17B, 18, and 19, when the ADF unit 33 is closed, the document retainer 43 is away from the stacker 42 being held over the stack 42 in place.

Just as the arm 44 of the first embodiment, the arm 50 extends over the ADF unit 33, and is pivotal with respect to the scanner unit 31. The arm 50 is pivotal about an axis Z-Z (FIG. 22) about which the ADF unit 33 pivots. Springs 51 and 52 are mounted on a rotational shaft, and urge the arm 50 in a direction shown by arrow A at all times. The arm 50 includes short projections 50*a* that project in a direction perpendicular to the rotational axis of the arm 50.

The links 53, ribs 55, and guide pins 54 are disposed in the vicinity of the rotational shaft of the arm 50 at positions that are mirror images of one another with respect to substantially a mid point of the width of the printer 10. The links 53 are guided by the ribs 55 and guide pins 54 disposed on the scanner unit 31, so that the links 53 are movable along an elongated hole 53*a* formed in the link 53. The guide pins 54 are press-fitted or screwed into holes 53*a* formed in the scanner unit 31. When the links 53 abut the short projections 50*a* (FIG. 18B), the links 53 serve as a stopper to prevent the arm 50 urged by the springs 51 and 52 in the A direction from moving any further.

As shown in FIGS. 20-22, when the ADF unit 33 has been opened by a predetermined angle (e.g., 20°), the document retainer 43 contacts the upper surface of the stacker 42, and the link 53 no longer abuts an end portion 50*a* (FIG. 24B) of the arm 50.

The other portions of the configuration of the image forming apparatus are the same as those of the first embodiment.

The operation of the image forming apparatus will be described.

Figure 23:
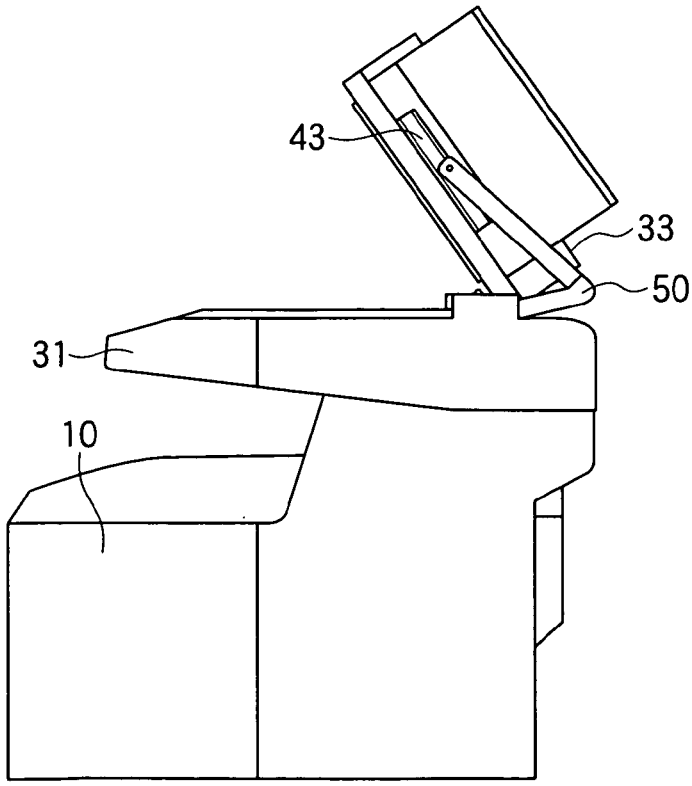
FIG. 23 is a right side view of the image forming apparatus when the ADF unit has been opened by an angle of 55°.

FIG. 23 is a right side view of the image forming apparatus when the ADF unit 33 has been opened by an angle of 55°.

Figure 24A:
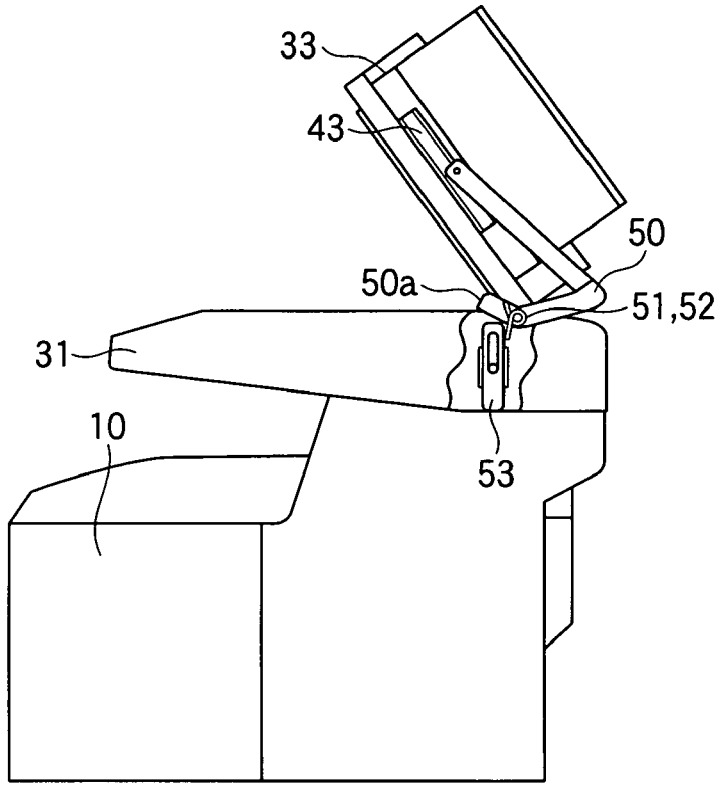
FIG. 24A is a partial cross-sectional view of the image forming apparatus when the ADF unit has been opened by an angle of 55°.
Figure 24B:
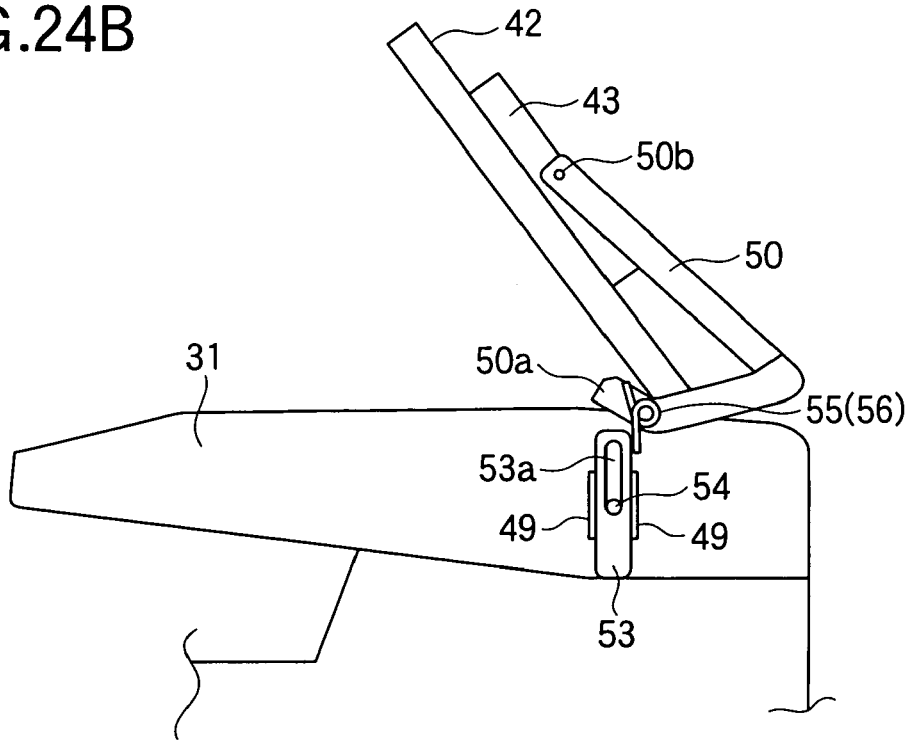
FIG. 24B illustrates the positional relationship between the arm and the link.

FIG. 24A is a partial cross-sectional view of the image forming apparatus when the ADF unit 33 has been opened by an angle of 55°. FIG. 24B illustrates the positional relationship between the arm 50 and the link 53.

Figure 25:
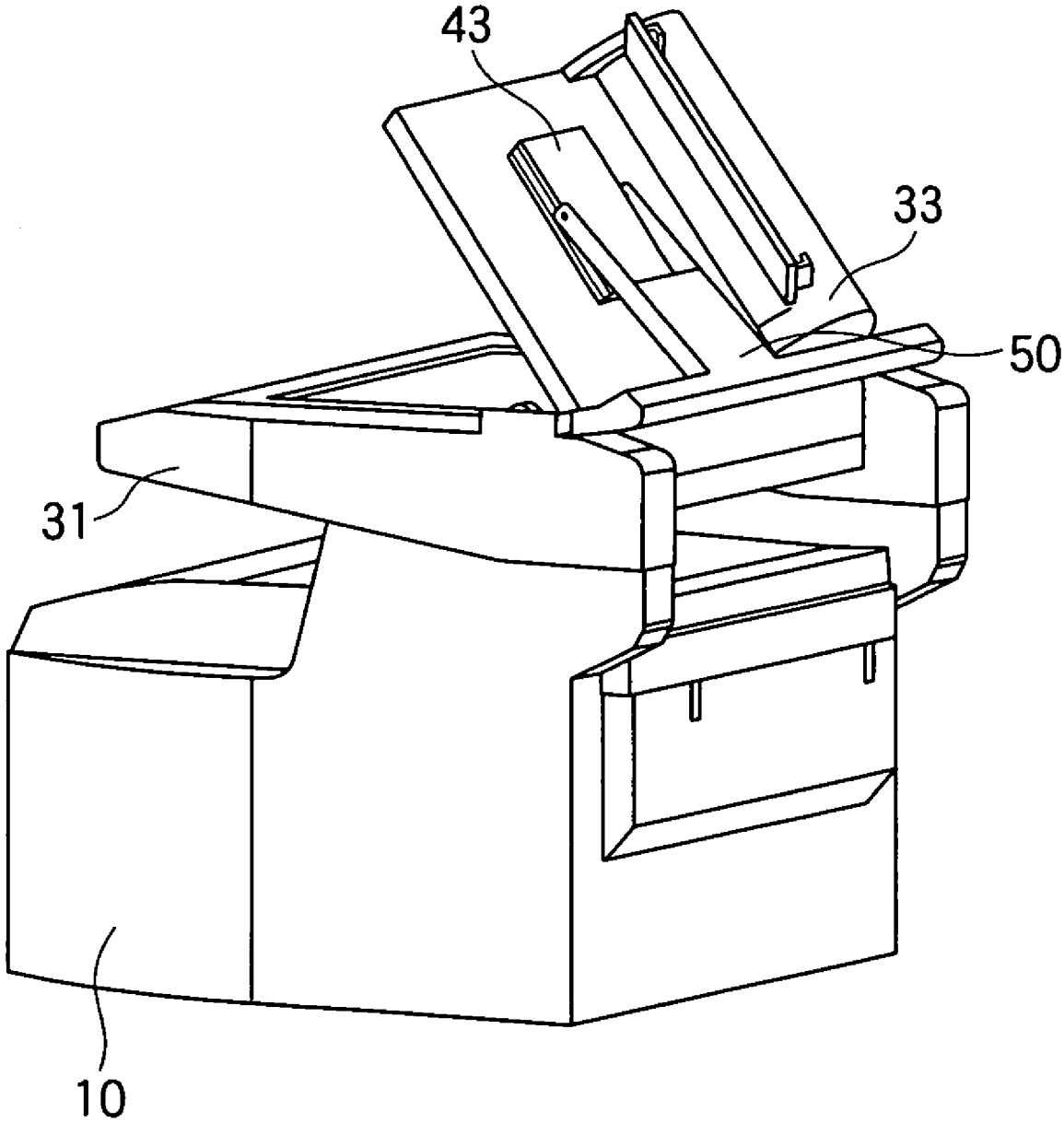
FIG. 25 is a perspective rear view of the image forming apparatus when the ADF unit has been opened by an angle of 55°.

FIG. 25 is a perspective rear view of the image forming apparatus when the ADF unit 33 has been opened by an angle of 55°.

Figure 26:
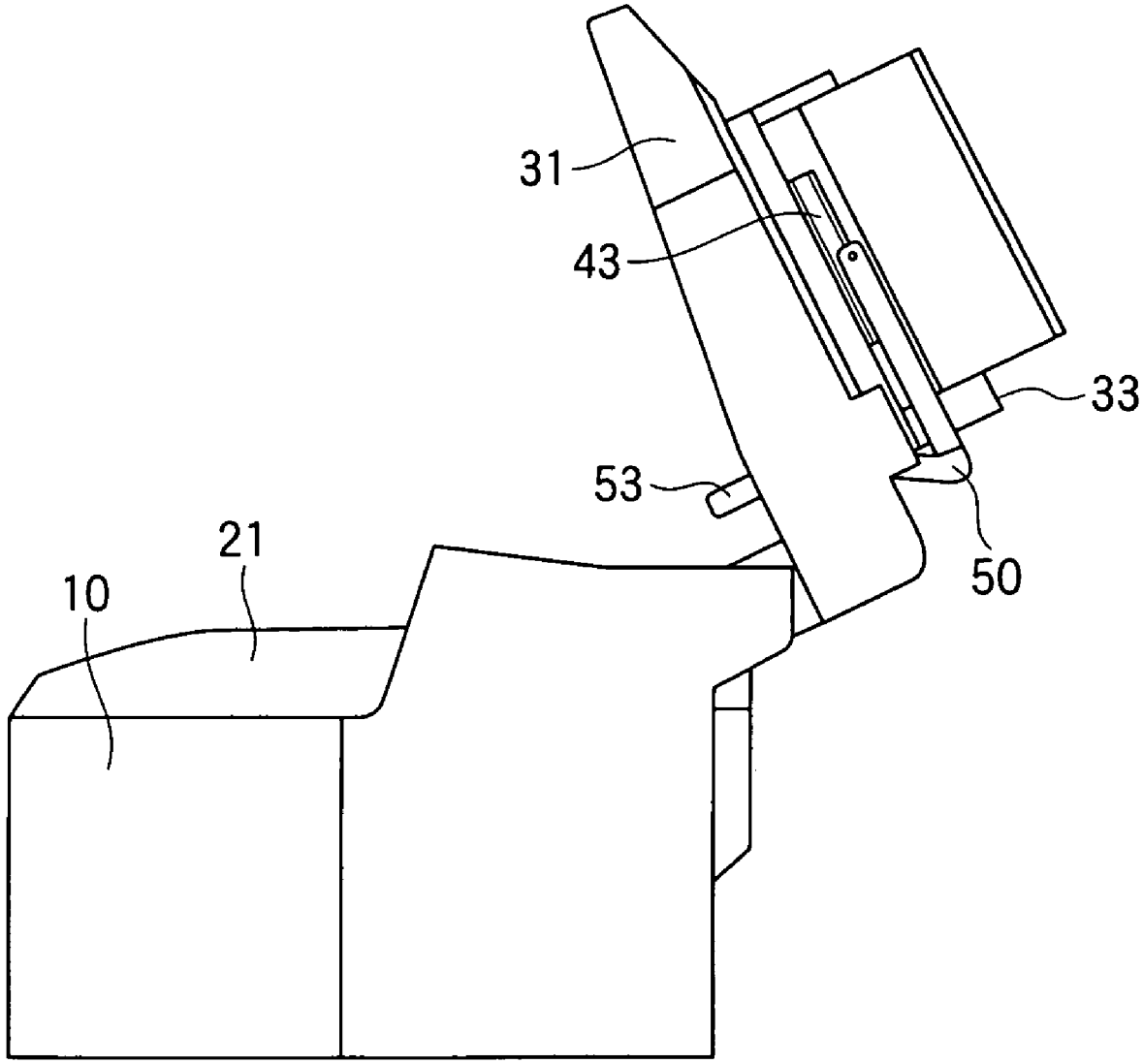
FIG. 26 is a right side view of the image forming apparatus when the scanner unit 31 has been opened by an angle of 65°.

FIG. 26 is a right side view of the image forming apparatus when the scanner unit 31 has been opened by an angle of 65°.

Figure 27A:
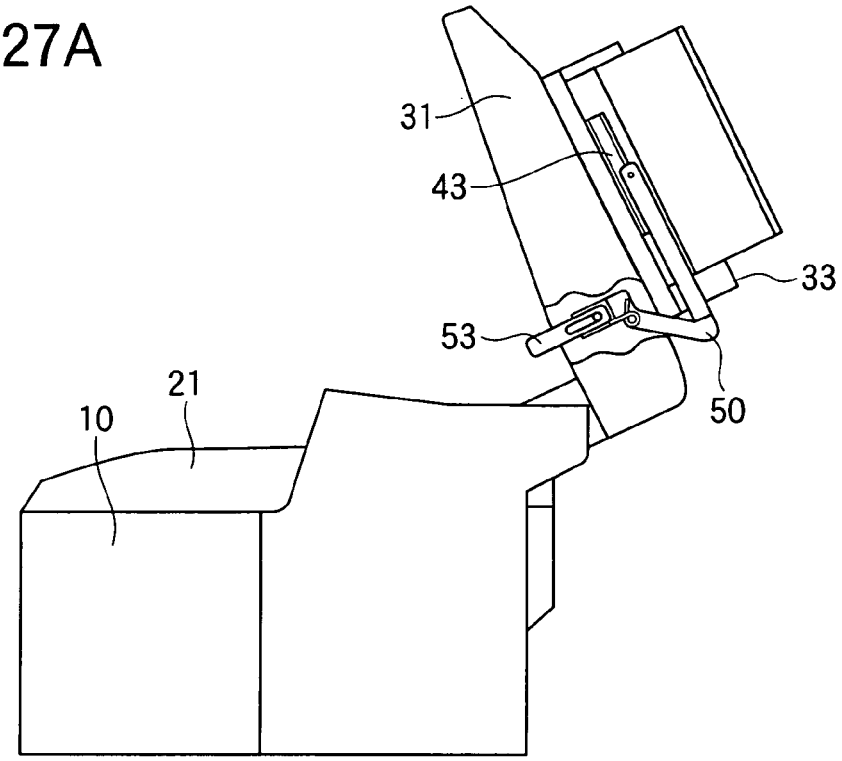
FIG. 27A is a partial cross-sectional view of the image forming apparatus when the scanner unit has been opened by an angle of 65°.

FIG. 27A is a partial cross-sectional view of the image forming apparatus when the scanner unit 31 has been opened by an angle of 65°.

Figure 27B:
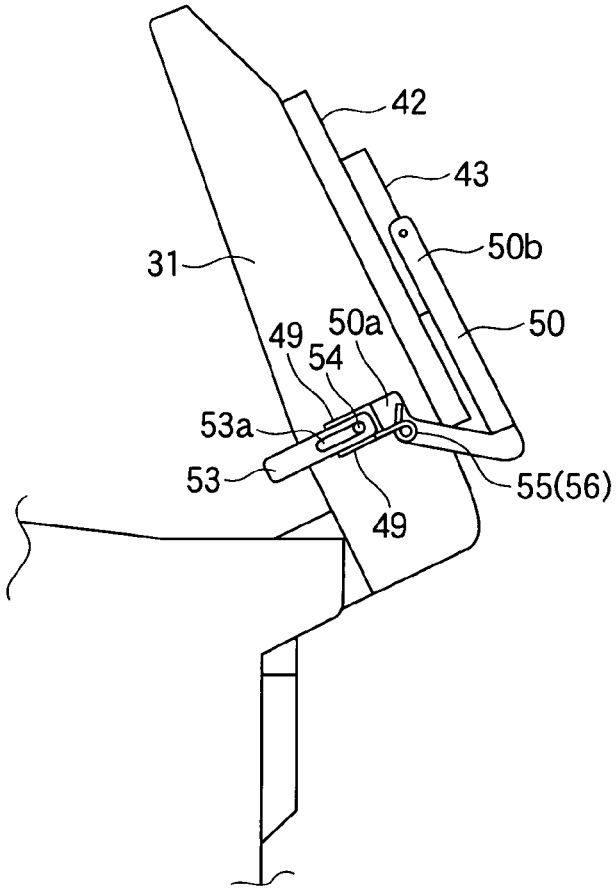
FIG. 27B illustrates the positional relationship between the arm and the link.

FIG. 27B illustrates the positional relationship between the arm 50 and the link 53.

Figure 28:
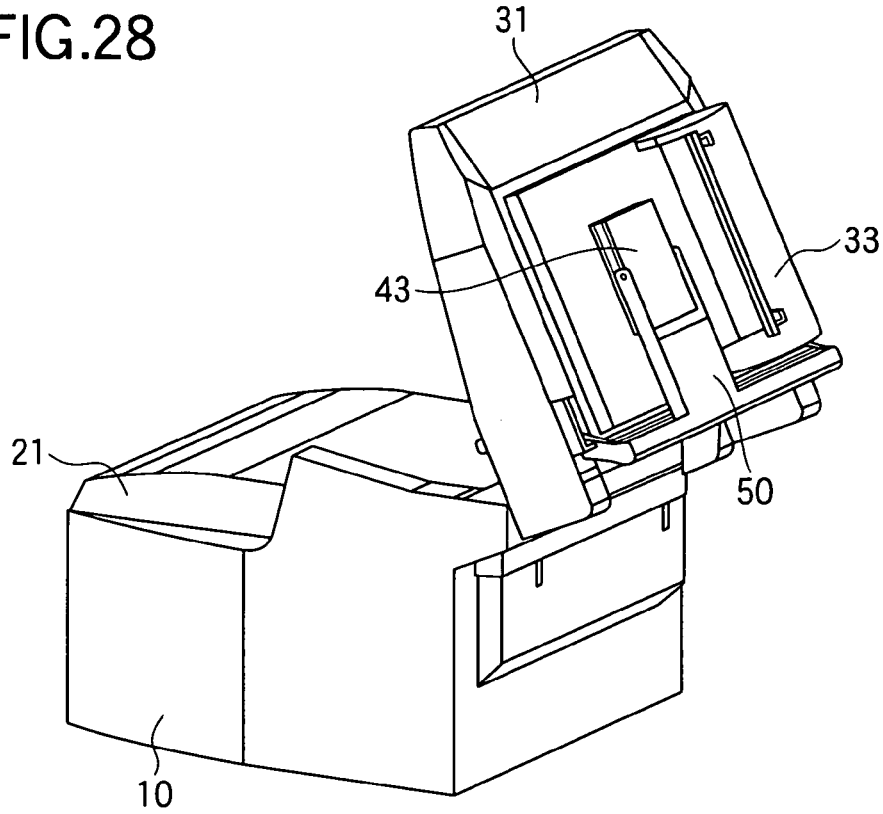
FIG. 28 is a perspective rear view of the image forming apparatus when the scanner unit has been opened by an angle of 65°.

FIG. 28 is a perspective rear view of the image forming apparatus when the scanner unit 31 has been opened by an angle of 65°.

Figure 29:
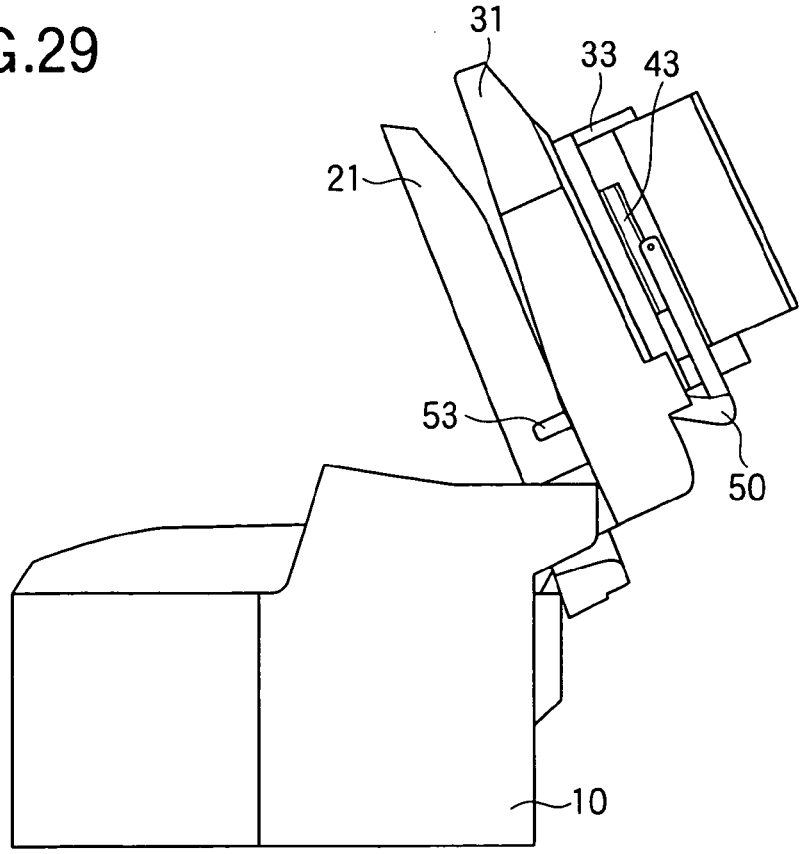
FIG. 29 is a right side view of the image forming apparatus when the scanner unit has opened by an angle of 65° and the printer cover 21 has been opened by an angle of 70°.

FIG. 29 is a right side view of the image forming apparatus when the scanner unit 31 has opened by an angle of 65° and the printer cover 21 has been opened by an angle of 70°.

Figure 30:
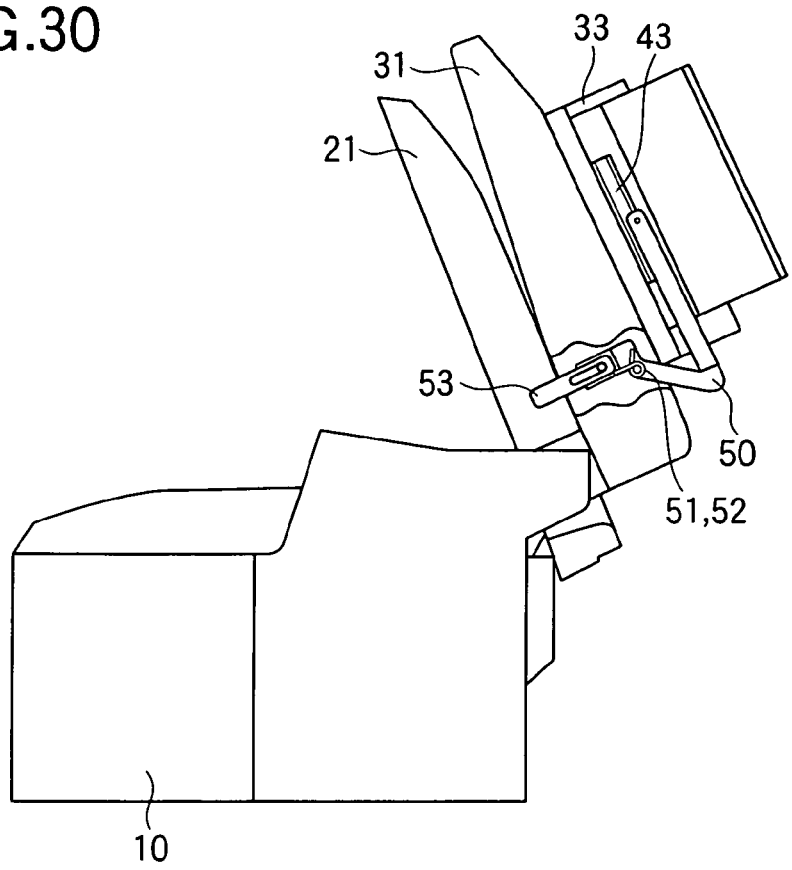
FIG. 30 is a partial cross-sectional view of the image forming apparatus when the scanner unit has been opened by an angle of 65° and the printer cover has been opened by an angle of 70°.

FIG. 30 is a partial cross-sectional view of the image forming apparatus when the scanner unit 31 has been opened by an angle of 65° and the printer cover 21 has been opened by an angle of 70°.

Figure 31:
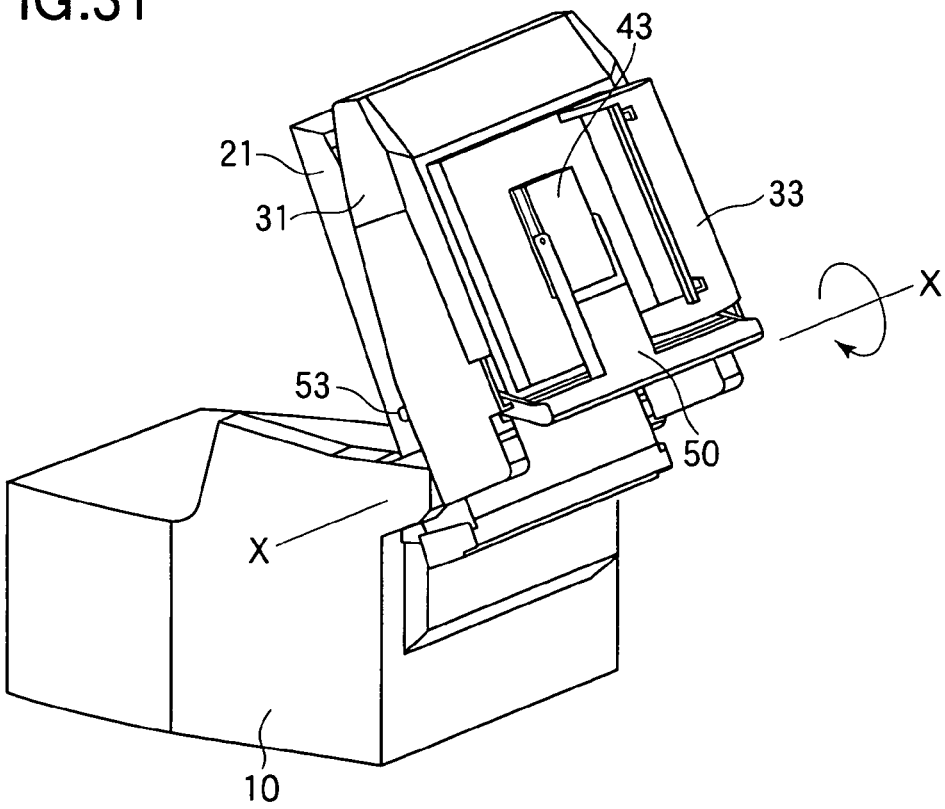
FIG. 31 is a perspective rear view of an image forming apparatus of a third embodiment when a scanner unit has been opened by an angle of 65° and a printer cover has been opened by an angle of 70°.

FIG. 31 is a perspective rear view of the image forming apparatus when the scanner unit 31 has been opened by an angle of 65° and the printer cover 21 has been opened by an angle of 70°.

Referring to FIGS. 17-19, the ADF unit 33 and the scanner unit 31 are closed, and the image forming apparatus is in normal use. The links 53 are resting on the printer 10, serving as a stopper to prevent the arm 50 urged by the springs 51 and 52 from pivoting in the A direction any further. Consequently, the document retainer 43 mounted to a tip portion of the arm 50 is held in position. Each of the links 53 is guided by the ribs 49 and the guide pin 54 so that the link 53 is vertically movable by its own weight. The guide pin 54 is either press-fitted or screwed into the scanner 31 through the elongated hole 53*a* formed in the link 53.

For example, assume that the user wishes to make a copy of a document. When the user opens the ADF unit 33, he may find a sheet of document for the immediately preceding copying job remaining on the flatbed. When the user opens the ADF unit 33 by an angle of approximately 20° as shown in FIGS. 20-22, the document retainer 43 begins to press the document on the stacker 42 against the stacker 42.

Referring to FIGS. 23-25, when the ADF unit 33 has been opened by such an angle that the user can see the surface of the flatbed glass, a portion 50*a* (FIG. 24) of the arm 50 moves upward out of engagement with the link 53, and the arm 50 follows the ADF unit 33 in an opening direction, while being urged by the springs 51 and 52.

Subsequently, the user places the document on the flatbed glass. Then, the user closes the ADF unit 33 as shown in FIGS. 17-19, and initiates a copying operation.

When, for example, a paper jam occurs in the printer 10 in the middle of the copying operation, the user is allowed to open the scanner unit 31 as shown in FIGS. 26-28 without having to pay any attention to the document remaining on the stacker 42.

Because the link 53 is loosely guided by the ribs 55 and the guide pin 54, opening the scanner unit 31 allows the link 53 to slide downward due to its own weight along the elongated hole 53*a* (FIG. 24B) while being guided by the ribs 55. The urging forces of the springs 51 and 52 cause the arm 50 to pivot so that the document retainer 43 mounted to a tip portion of the arm 50 presses the stacker 42.

Subsequently, as shown in FIGS. 29-31, the user opens the printer cover 21 that covers the upper surface of the printer 10, and removes the jammed paper. The user may also replace the toner cartridge and image drum of the image drum unit 17 disposed in the printer 10. After the jammed paper has been removed, the user closes the printer cover 21 to return the scanner unit 31 to its normal position, so that the arm 50 and document retainer 43 return to their original position.

As described above, the arm 50 and document retainer 43 allow the ADF unit 33 and scanner unit 31 to open and close while preventing the document from dropping from the stacker 42 of the ADF unit 33. This facilitates removal of jammed paper.

In the first embodiment, the ADF unit 33 and the arm 44 pivot about different pivotal axes. Thus, when the ADF unit 33 has been opened from an angle of 20° to an angle of 55°, the document retainer 43 displaces on the stacker 42 due to the difference in pivotal locus between the ADF unit 33 and the arm 44. In the second embodiment, the arm 50 and the ADF unit 33 pivot about the same axis so that even when the ADF unit 33 has been opened from an angle of 20° to an angle of 55°, the document retainer 43 will not displace.

Third Embodiment

Elements similar to those of the first and second embodiments have been given the same reference numerals and their description is omitted. The description of the operations and advantages of the portions common to the first and second embodiments is also omitted.

Figure 32:
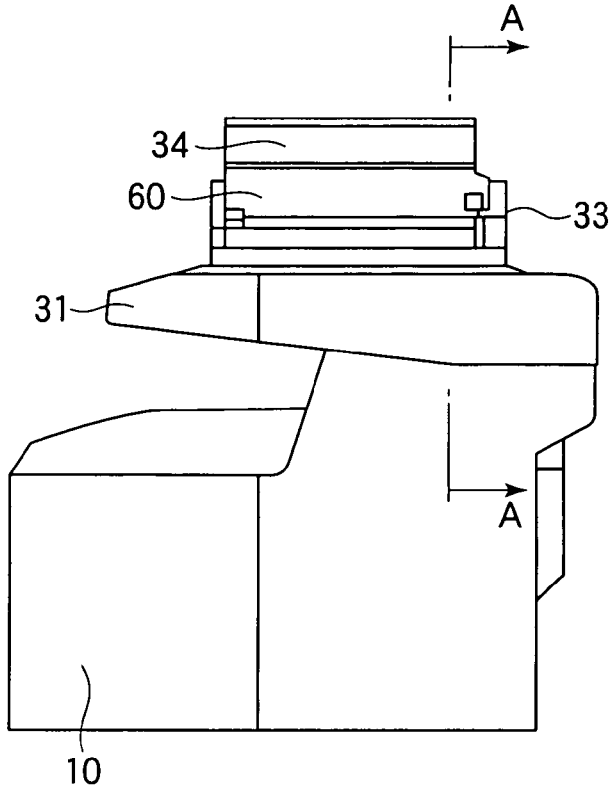
FIG. 32 is a right side view of the image forming apparatus when an ADF unit has been closed.

FIG. 32 is a right side view of the image forming apparatus when an ADF unit 33 has been closed.

Figure 33:
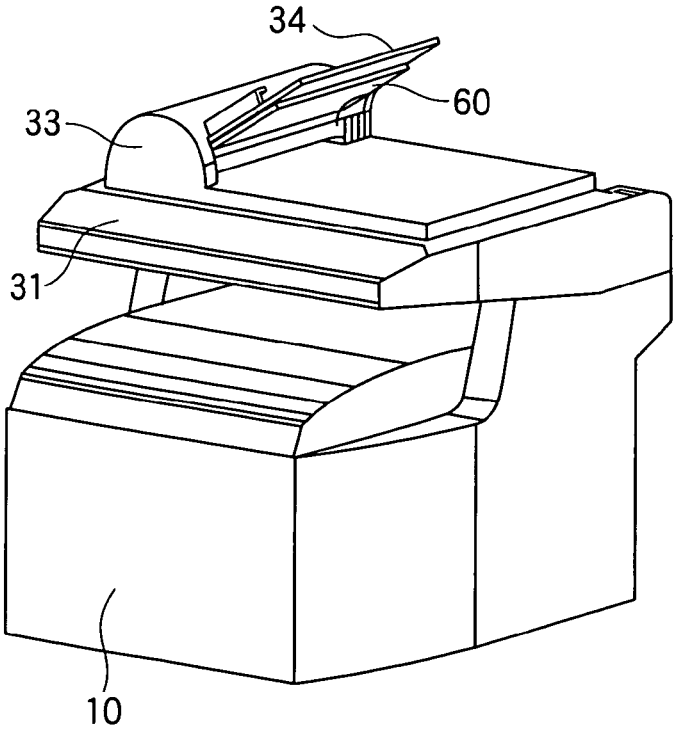
FIG. 33 is a perspective front view of the image forming apparatus when the ADF unit has been closed.

FIG. 33 is a perspective front view of the image forming apparatus when the ADF unit 33 has been closed.

Figure 34:
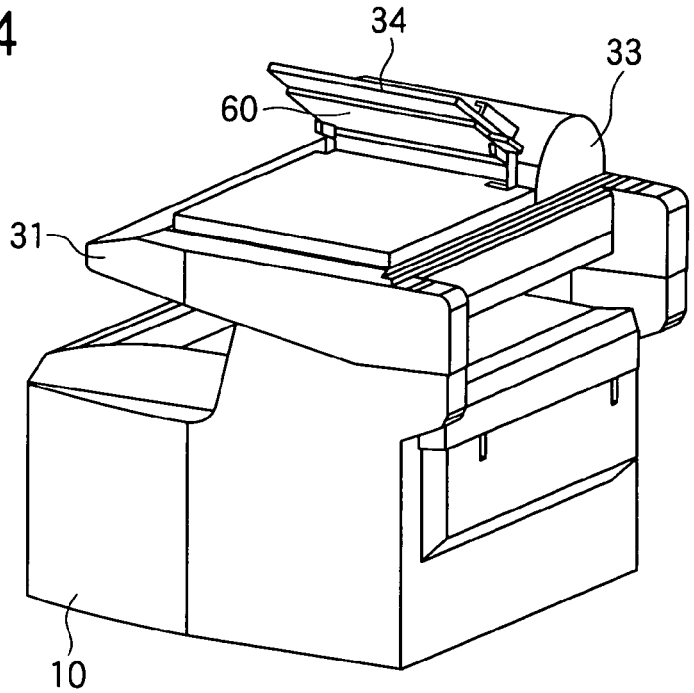
FIG. 34 is a perspective rear view of the image forming apparatus when the ADF unit has been closed.

FIG. 34 is a perspective rear view of the image forming apparatus when the ADF unit 33 has been closed.

Figure 35:
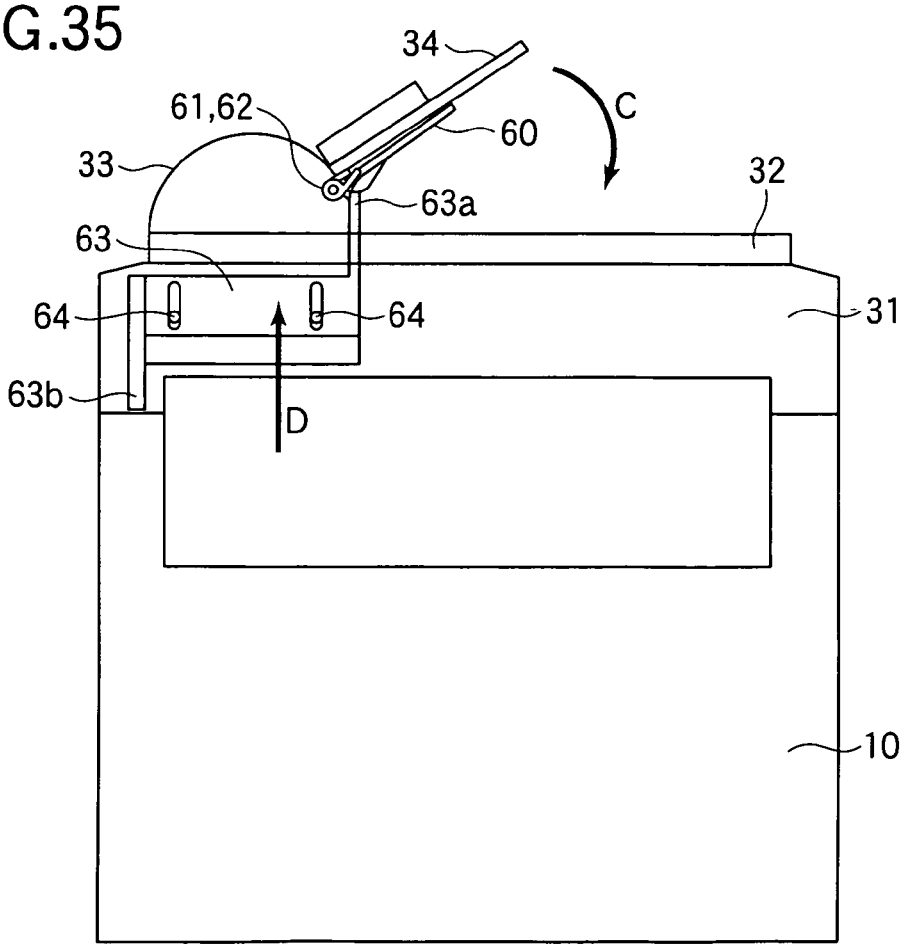
FIG. 35 is a cross-sectional view taken along a line A-A of FIG. 32, illustrating the image forming apparatus in which the scanner unit rests on a printer.

FIG. 35 is a cross-sectional view taken along a line A-A of FIG. 32, illustrating the image forming apparatus in which the scanner unit 31 rests on a printer 10.

Figure 36:
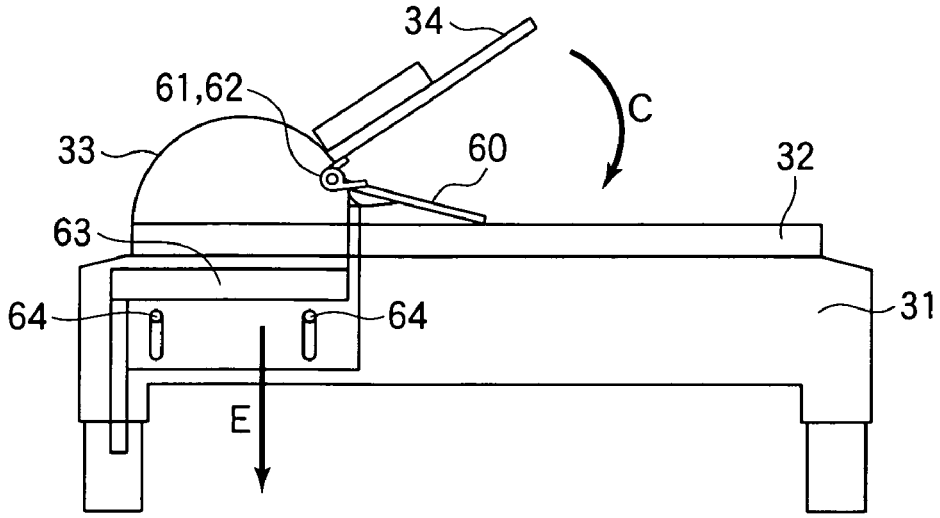
FIG. 36 is a cross-sectional view of the image forming apparatus, showing the scanner unit away from the printer.

FIG. 36 is a cross-sectional view of the image forming apparatus, showing the scanner unit 31 away from the printer 10.

A document retainer 60 is pivotally mounted on the underside of a tray 34 of the ADF unit 33 and presses the document against a stacker 42. Referring to FIGS. 32-36, just as in the first and second embodiments, when the ADF unit 33 is closed, the document retainer 60 is away from the stacker 42 and is held over the stacker 42 in place.

The document retainer 60 pivots about a shaft which is a part of the ADF unit 33. Torsion springs 61 and 62 fit over the shaft and urge the document retainer 60 in a direction shown by arrow C.

A link 63 is mounted inside of the scanner unit 31, and serves as a stopper to prevent the document retainer 60 urged by springs 61 and 62 in a direction shown by arrow C from pivoting any further. The link 63 is guided by two guide pins 64 to move in directions shown by arrows D and E. The upper end 63*a* of the link 63 projects through a hole formed in the scanner cover 32, and abuts the lower surface of the document retainer 60. The lower end 63*b* of the link 63 projects downwardly from the scanner unit 31.

After the ADF unit 33 has been closed, the scanner unit 31 rests on the printer 10. Thus, the lower end 63*b* of the link 63 abuts a part of the printer 10 as shown in FIG. 35, so that the link 63 is moved relative to the guide pins 64 in a direction shown by arrow D. The upper end 63*a* of the link 63 pushes up the document retainer 60 in the D direction.

When the scanner unit 31 pivots away from the printer 10 as shown in FIG. 36, the urging forces of the springs 61 and 62 cause the link 63 to slide in the E direction.

The rest of the configuration of the image forming apparatus is much the same as that of the first and second embodiments, and its description is omitted.

Figure 37:
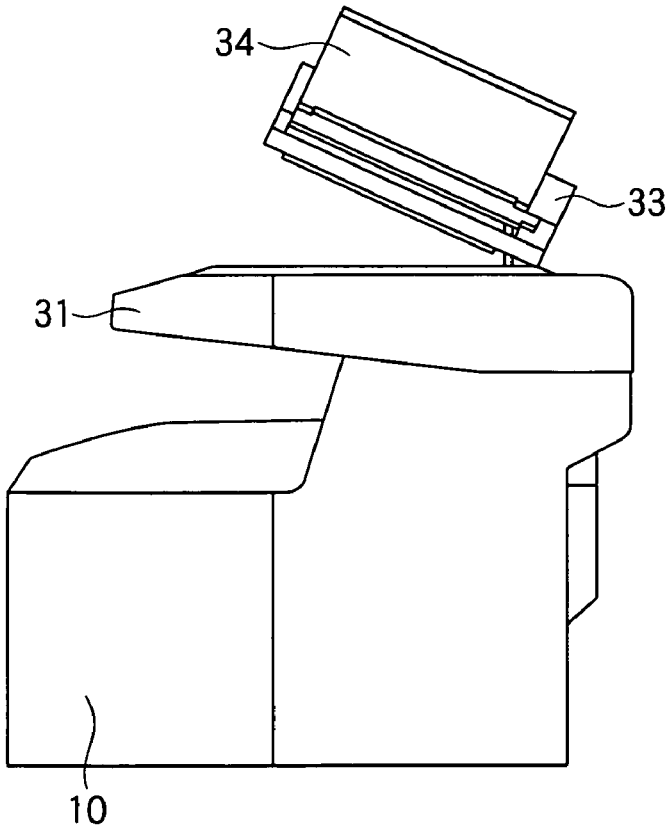
FIG. 37 is a right side view of the image forming apparatus when the ADF unit has been opened by an angle of 20°.

FIG. 37 is a right side view of the image forming apparatus when the ADF unit 33 has been opened by an angle of 20°.

Figure 38:
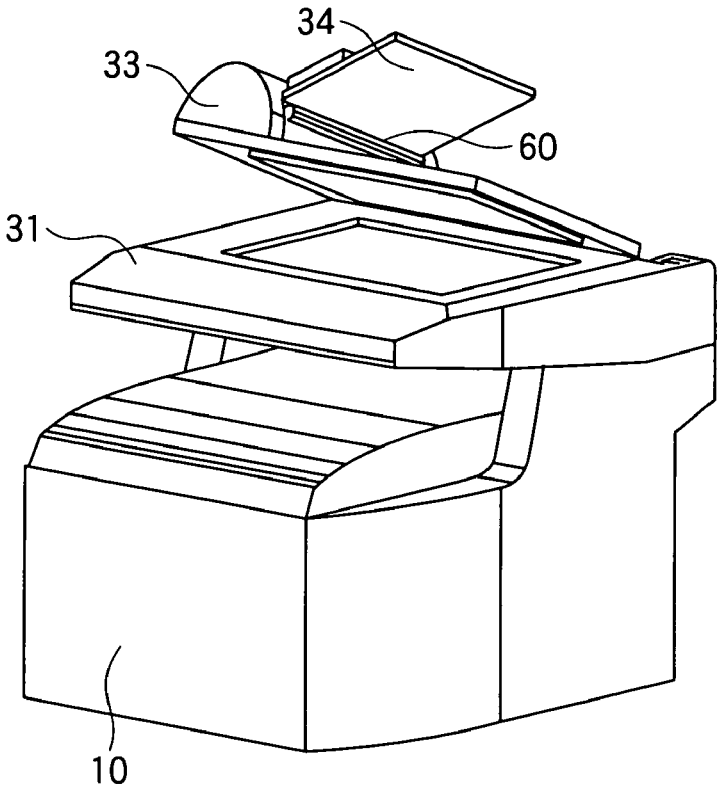
FIG. 38 is a perspective front view of the image forming apparatus when the ADF unit has been opened by an angle of 20°.

FIG. 38 is a perspective front view of the image forming apparatus when the ADF unit 33 has been opened by an angle of 20°.

Figure 39:
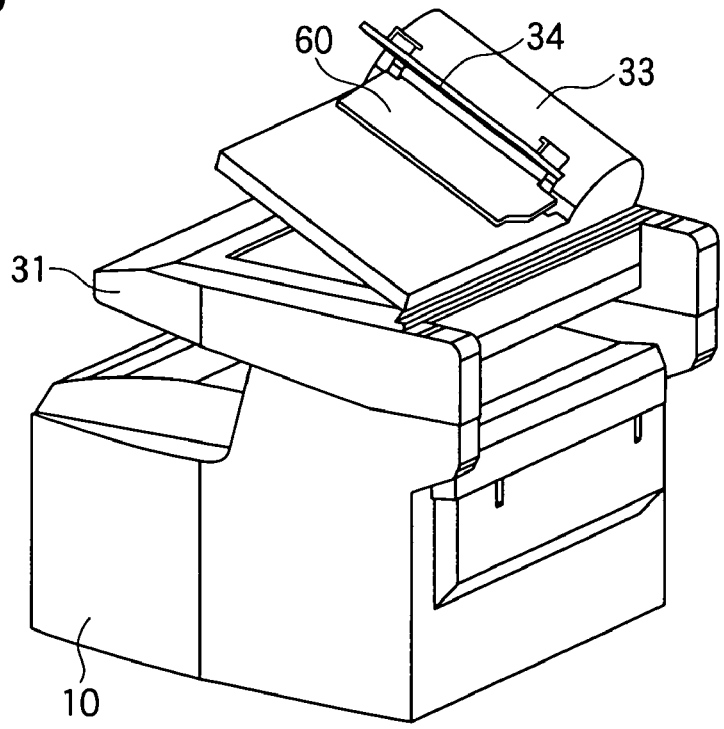
FIG. 39 is a perspective rear view of the image forming apparatus when the ADF unit has been opened by an angle of 20°.

FIG. 39 is a perspective rear view of the image forming apparatus when the ADF unit 33 has been opened by an angle of 20°.

Figure 40:
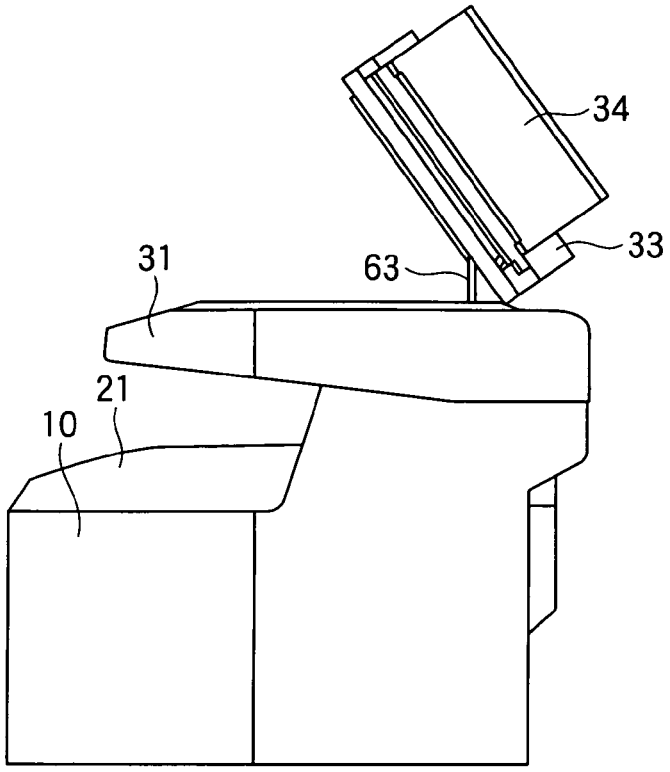
FIG. 40 is a right side view of the image forming apparatus when the ADF unit has been opened by an angle of 55°.

FIG. 40 is a right side view of the image forming apparatus when the ADF unit 33 has been opened by an angle of 55°.

Figure 41:
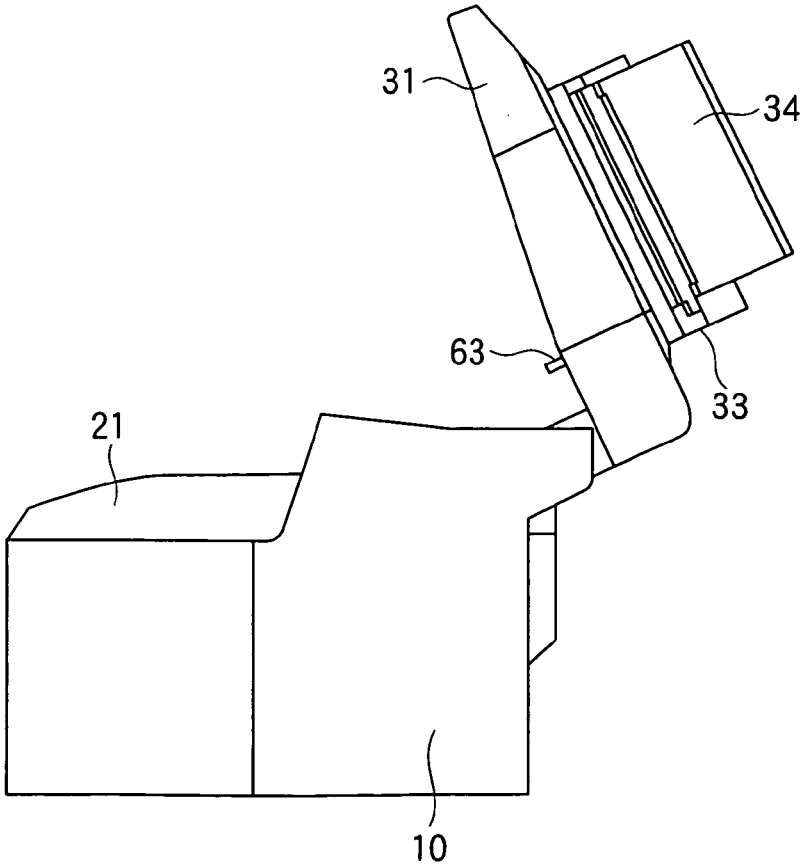
FIG. 41 is a right side view of the image forming apparatus when the scanner unit has been opened by an angle of 65°.

FIG. 41 is a right side view of the image forming apparatus when the scanner unit 31 has been opened by an angle of 65°.

Figure 42:
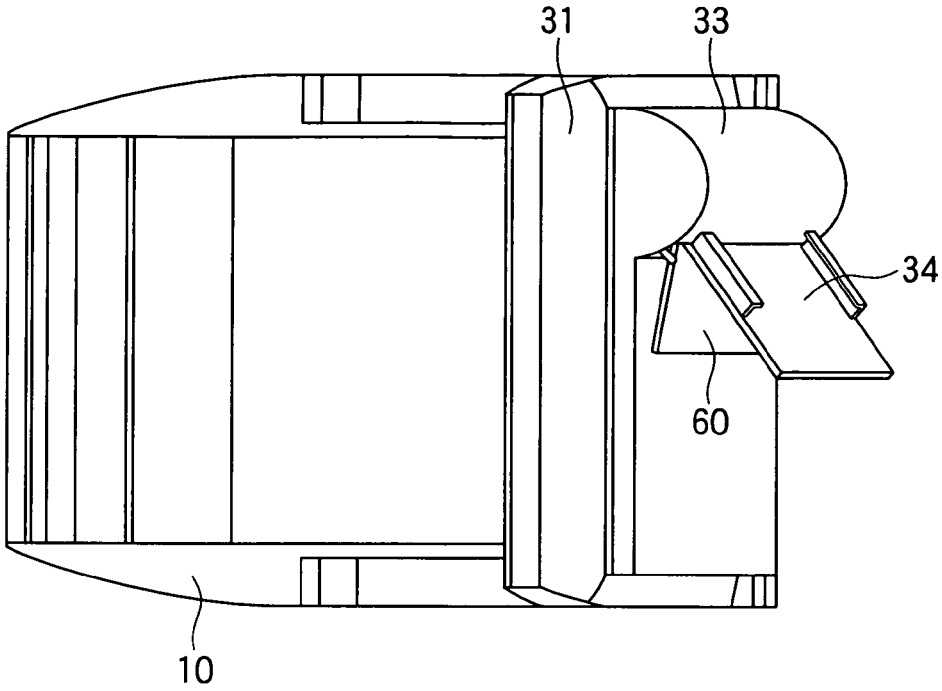
FIG. 42 is a top view of the image forming apparatus when the scanner unit has been opened by an angle of 65°.

FIG. 42 is a top view of the image forming apparatus when the scanner unit 31 has been opened by an angle of 65°.

Figure 43:
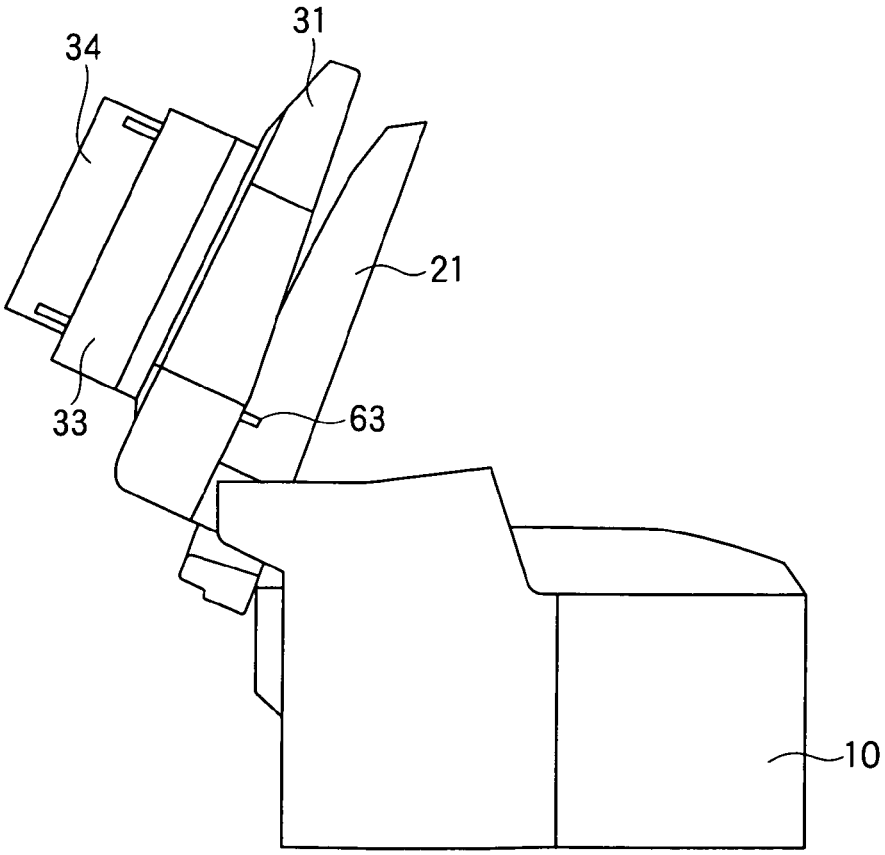
FIG. 43 is a left side view of the image forming apparatus when the scanner unit has been opened by an angle of 65° and the printer cover has been opened by an angle of 70°.

FIG. 43 is a left side view of the image forming apparatus when the scanner unit 31 has been opened by an angle of 65° and the printer cover has been opened by an angle of 70°.

FIGS. 32-34 illustrate the ADF unit 33 and scanner unit 31 when they are closed and the image forming apparatus is in normal use. Because the scanner unit 31 is resting on the printer 10, the link 63 moves in a direction shown by arrow D, the upper end of the link 63 pushing up the document retainer 60 in the D direction. Because the springs 61 and 62 urge the document retainer 60 in a direction shown by arrow C, the document retainer 60 is held in a predetermined position.

For example, assume that the user wishes to make a copy of a document. When the user opens the ADF unit 33, he may find a sheet of document for the immediately preceding copying job remaining on the flatbed. When the user opens the ADF unit 33 by an angle of approximately 20° as shown in FIGS. 37-39, the document retainer 60 begins to press the document placed on the stacker 42 against the stacker 42.

Referring to FIG. 41, when the ADF unit 33 has been opened by such an angle that the user can see the upper surface of the flatbed glass, the shaft of the arm 50 is away from a portion 63*a* of the link 63. The document retainer 60 follows the ADF unit 33 in such a direction as to open the ADF unit 33, while being urged by the springs 61 and 62 against the stacker 42.

Subsequently, the user places the document on the flatbed glass. Then, the user closes the ADF unit 33 as shown in FIGS. 32-34, and initiates a copying operation.

When, for example, a paper jam occurs in the printer 10 in the middle of a copying operation, the user is allowed to open the scanner unit 31 as shown in FIGS. 41 and 42 without having to pay any attention to the document remaining on the stacker 42.

The link 63 has an elongated hole formed therein and is loosely guided by the ribs 55 and the guide pin 64. Opening the scanner unit 31 allows the link 63 to slide downward due to its own weight along the elongated hole while being guided by the ribs 55. Just as in the first embodiment, the link 63 is guided by the guide pins 64 and the ribs 55 on the scanner unit 31 to slide downward. The urging forces of the springs 61 and 62 cause the document retainer 60 to pivot so that the document retainer 60 is pressed against the stacker 42.

Subsequently, as shown in FIG. 43, the user opens the printer cover 21 that covers the upper surface of the printer 10, and removes the jammed paper. The user may also replace the toner cartridge and image drum of the image drum unit 17 attached to the printer 10. After the jammed paper has been removed, the user closes the printer cover 21, allowing the scanner unit 31 to return to its normal position, so that the link 63 and the document retainer 60 return to their original position.

As described above, the document retainer 60 and arm 50 allows the ADF unit 33 and scanner unit 31 to open and close while preventing the document from dropping from the stacker 42 of the ADF unit 33. This facilitates removal of the jammed paper from the printer 10.

In the second embodiment, the arm 50 is urged in the A direction by the springs 51 and 52. Therefore, if the ADF unit 33 is opened by an angle greater than about 20°, a reaction may be exerted on the arm 50. In the third embodiment, the springs 61 and 62 and the document retainer 60 are all accommodated in the ADF unit 33 so that no adverse effect is given to the arm 50.

The ADF unit 33 may be of a type that is or is not detachably attachable to the image reading apparatus 30 or printer 10 (printers, facsimile machines, multi function printer incorporating a printer function and a scanner function).

The invention being thus described, it will be obvious that the same may be varied in many ways. Such variations are not to be regarded as a departure from the scope of the invention, and all such modifications as would be obvious to one skilled in the art intended to be included within the scope of the following claims.

What is claimed is:

1. An image reading apparatus comprising:

an image reader that reads an image of a document;

a document feeder, that includes a stacker, that feeds the document to the image reader, the document feeder discharging the document onto the stacker after the image of the document has been read, the document feeder being pivotal relative to the image reader;

a document retaining mechanism that extends over the image reader and retains the discharged document on the stacker, the document retaining mechanism including a supporting member and a retainer member, the retainer member having a flat surface, the supporting member having an end portion pivotally connected to the image reader and another end portion to which the retainer member is pivotally mounted, wherein when the document feeder opens relative to the image reader, the flat surface of the retainer member presses the discharged document against the stacker;

an urging member that urges the supporting member so that the retainer member presses the discharged document against the stacker;

a body; and a stopper mounted to the image reader, the stopper being movable relative to the image reader, wherein the image reader is pivotally mounted to the body, wherein when the image reader and the document retaining mechanism are pivoted to close relative to the body, the stopper is sandwiched between the body and the supporting member so that the stopper prevents the supporting member from pivoting towards the stacker, further when the image reader and the document retaining mechanism are pivoted to open relative to the body, the stopper slides relative to the image reader out of engagement with the supporting member, allowing the supporting member to pivot toward the stacker so that the retainer member presses the discharged document against the stacker.

2. The image reading apparatus according to claim 1, wherein when the document retaining mechanism opens relative to the image reader to increase an angle therebetween, the retainer member presses the discharged document against the stacker.

3. The image reading apparatus according to claim 1, wherein the document retaining mechanism pivots relative to the image reader about an axis extending substantially parallel to a direction in which the document is discharged.

4. The image reading apparatus according to claim 1, wherein the document retaining mechanism pivots relative to the image reader about an axis extending substantially perpendicular to a direction in which the document is discharged.

5. The image reading apparatus according to claim 1, wherein the document feeder and the document retaining mechanism pivot about a common axis.

6. The image reading apparatus according to claim 1, wherein the document feeder is opened relative to the image reader and the flat surface of the retainer member presses the discharged document against the stacker.

7. An image forming apparatus comprising:

an image reading unit including an image reader that reads an image of a document, and a document feeder that feeds the document to the image reader and discharges the document after the image of the document has been read;

an image forming unit to which the image reading unit is pivotally mounted, the image forming unit printing the image read by the image reader;

a stacker for receiving the discharged document; and a document retaining mechanism that presses the discharged document against the stacker in an interlocked manner with pivotal motion of the image reading unit and pivotal motion of the document feeder.

8. The image forming apparatus according to claim 7, further comprising an urging member that urges the discharged document, the discharged document being pressed against the stacker after the image reading unit has opened by an angle relative to the image forming unit.

9. The image forming apparatus according to claim 7, wherein the document retaining mechanism pivots relative to the image reader about an axis extending substantially parallel to a direction in which the document is discharged.

10. The image forming apparatus according to claim 7, further comprising:

a lid that closes the image forming unit; and an urging member that urges the discharged document, the discharged document being pressed against the lid after the image reading unit has opened to increase an angle between the image reading unit and the image forming unit.

11. The image forming apparatus according to claim 7, wherein the image reading unit includes a document receiving platform on which the document is placed, wherein the document retaining mechanism is disposed in the vicinity of the document receiving platform and the document retaining mechanism pivots relative to the image reader about an axis substantially perpendicular to a direction in which the document is discharged.

12. The image forming apparatus according to claim 7, further comprising an urging member that urges the document retaining mechanism toward the stacker so that the document retaining mechanism presses the discharged document against the stacker.

13. The image forming apparatus according to claim 12, further comprising:

a body; and a stopper mounted to the image reader, the stopper being movable relative to the image reader, wherein the image reader is pivotally mounted to the body, wherein the document retaining mechanism includes a supporting member, wherein when the image reader and the document retaining mechanism are pivoted to close relative to the body, the stopper is sandwiched between the body and the supporting member so that the stopper prevents the supporting member from pivoting toward the stacker, wherein when the image reader and the document retaining mechanism are pivoted to open relative to the body, the stopper slides relative to the image reader to move out of engagement with the supporting member to allow the supporting member to pivot towards the stacker so that the retainer member presses the discharged document against the stacker.

* * * * *